US006960553B2

(12) United States Patent
Kato et al.

(10) Patent No.: US 6,960,553 B2
(45) Date of Patent: Nov. 1, 2005

(54) HEAT-SENSITIVE RECORDING MATERIAL

(75) Inventors: Takahisa Kato, Tokyo (JP); Hidetaka Tsukada, Tokyo (JP); Shoji Hizatate, Tokyo (JP); Shigetoshi Hiraishi, Tokyo (JP); Kiichiro Wakamatsu, Tokyo (JP); Katsuya Shito, Tokyo (JP); Makoto Ida, Tokyo (JP)

(73) Assignee: Mitsubishi Paper Mills Ltd., Tokyo (JP)

( * ) Notice: Subject to any disclaimer, the term of this patent is extended or adjusted under 35 U.S.C. 154(b) by 21 days.

(21) Appl. No.: 10/364,458

(22) Filed: Feb. 12, 2003

(65) Prior Publication Data

US 2003/0186810 A1 Oct. 2, 2003

Related U.S. Application Data

(63) Continuation of application No. 09/528,002, filed on Mar. 17, 2000, now abandoned.

(30) Foreign Application Priority Data

| | | |
|---|---|---|
| Mar. 17, 1999 | (JP) | H11-071801 |
| Mar. 30, 1999 | (JP) | H11-087500 |
| Apr. 23, 1999 | (JP) | H11-116743 |
| Jun. 11, 1999 | (JP) | H11-165798 |
| Jun. 18, 1999 | (JP) | H11-172667 |
| Jun. 30, 1999 | (JP) | H11-186071 |

(51) Int. Cl.[7] ..... B41M 5/30
(52) U.S. Cl. ..... 503/216; 503/225
(58) Field of Search ..... 427/150, 151; 503/216, 225, 217

(56) References Cited

U.S. PATENT DOCUMENTS

| | | | | |
|---|---|---|---|---|
| 4,940,691 | A | | 7/1990 | Iiyama et al. |
| 5,731,262 | A | * | 3/1998 | Ogino et al. ..... 503/207 |

FOREIGN PATENT DOCUMENTS

| | | |
|---|---|---|
| JP | 57-11088 | 1/1982 |
| JP | 57-169393 | 10/1982 |
| JP | 58-126189 | 7/1983 |
| JP | 61-160292 | 7/1986 |
| JP | 62-169681 | 7/1987 |
| JP | 63-22683 | 1/1988 |
| JP | 63-95977 | 4/1988 |
| JP | 7-149713 | 6/1995 |
| JP | 9-8605 | 1/1997 |
| JP | 10-862 | 1/1998 |
| JP | 10-29969 | 2/1998 |
| JP | 10-35109 | 2/1998 |

* cited by examiner

*Primary Examiner*—Bruce H. Hess
(74) *Attorney, Agent, or Firm*—Nixon & Vanderhye P.C.

(57) ABSTRACT

Disclosed is a heat-sensitive recording material having excellent properties such as high color-forming sensitivity (excellent thermal response), a high formed color density, freedom from ground fogging and excellent retainability of recorded image. The heat-sensitive recording material has a heat-sensitive recording layer containing (1) at least two diphenylsulfone derivatives, (2) a combination of a diphenylsulfone derivative with a hydroxybenzoic acid derivative, (3) a combination of a diphenylsulfone derivative with a diphenyl ether derivative, (4) a combination of a diphenylsulfone derivative with salicylamide or a derivative thereof, or (5) a combination of 4,4'-dihydroxydiphenylsulfone, salicylanilide and dibenzyloxalate.

7 Claims, No Drawings

HEAT-SENSITIVE RECORDING MATERIAL

This application is a continuation of Ser. No. 09/528,002 filed on Mar. 17, 2000 now abandoned.

BACKGROUND OF THE INVENTION

1. Field of the Invention

The present invention relates to a heat-sensitive recording material. More specifically, it relates to a heat-sensitive recording material having excellent properties such as high color-forming sensitivity (excellent thermal response), a high color density, freedom from ground fogging and excellent image retainability.

2. Related Art Statement

Heat-sensitive recording materials generally have a substrate and a heat-sensitive recording layer formed thereon, and the heat-sensitive recording layer contains, as main components, an electron-donating colorless or light-color dye precursor and an electron-accepting color developer. When a heat-sensitive recording material is heated with a hot head, a hot pen or a laser beam, the dye precursor and the color developer immediately react with each other to give a recorded image. Advantageously, the above heat-sensitive recording materials permit recording with a relatively simple-structured device, and such a device is easy to maintain and makes almost no noise, so that the heat-sensitive recording materials are applied to broad fields including measurement meters, facsimile machines, printers, computer terminals, labeling machines, ticket vending machines, and the like.

In recent years, heat-sensitive recording materials have come to be used as financial recording sheets for bills and receipts of gas, water, electricity, etc., slips of automatic teller machines and various receipts.

As the use and demands of heat-sensitive recording materials have expanded into various fields as described above, the heat-sensitive recording materials have come to be required to have a variety of properties such as high color sensitivity and a high color density, freedom from ground fogging, stabilized image retainability and excellent thermal response.

Specifically, a heat-sensitive recording material gives an image when heated. When a high color-forming sensitivity (excellent thermal response) and a high color density are realized in a heat-sensitive recording material, a ground (non-recorded portion) of the heat-sensitive recording material forms a color when exposed to a high temperature. This is a so-called ground fogging phenomenon. When the ground fogging is intense, there is caused a defect that the contrast of the ground to a recorded image disappears when the image-recorded article is exposed to a high temperature.

Further, there is another problem that an image-recorded article is degraded by chemicals contained in cosmetics and stationery articles, the infiltration of a plasticizer contained in wrapping films such as a vinyl chloride film or light such as sunlight and fluorescence lamp light. It is therefore desired to develop a heat-sensitive recording material which satisfies contradictory properties, such as high color-forming sensitivity (excellent thermal response) and saturation concentration in combination with the prevention of ground fogging, and which has excellent image retainability.

As means for improving the retainability to an image portion, there is proposed a heat-sensitive recording material containing, as an electron-accepting compound, a salicylic acid derivative having a substituent such as an alkyl, aralkyl, alkyloxy or acyl group or a metal salt thereof (JP-A-62-169681, JP-A-63-22683 and JP-A-63-95977).

However, the above heat-sensitive recording material containing the salicylic acid derivative is not sufficient for image retainability. Further, it is poor in thermal response, so that it cannot be said to be competent for practically fast recording.

For improving the thermal response, a sensitizer is added as required. When the sensitizer is melted itself under transmitted heat energy, it works to melt or include a dye precursor and a color developer in its vicinity to promote a color forming reaction. It is therefore one means of increasing the sensitivity of the heat-sensitive recording material to improve the sensitizer in thermal response and compatibility with a dye precursor and a color developer.

As the above means, attempts have been made to add, for example, waxes, a nitrogen-containing compound, carboxylates, a naphthol derivative, a naphthoic acid derivative, a benzoate derivative, p-benzylbiphenyl or diphenoxyethane. However, a heat-sensitive recording material obtained is not yet satisfactory concerning color density and thermal response.

JP-A-9-8605 and JP-A-10-35109 disclose a thermal paper which shows excellent recorded image retainability under a high-temperature environment at 80° C. or higher, causes ground fogging to a less extent and has excellent recording sensitivity.

The above thermal paper exhibits excellent recorded image retainability against heat at a temperature around the boiling point of water. However, when it comes into contact with a heater device having a temperature higher than the above temperature, a ground portion completely forms a color, and a difference between the optical density of a recorded portion and the optical density of a ground portion disappears. As a result, a recording no longer exists. Therefore, there have been practically obtained no thermal paper having satisfactory recorded image retainability against heat for securities and documents which have financial values in themselves.

Examples of the above contact to high-temperature heat source include a case where the simple lamination of a polyolefine resin is applied to a heat-sensitive recording material and a case where an electric iron is erroneously pressed to a heat-sensitive recording material. In the laminating, a heat-sensitive recording material is brought into contact with a heat source having a temperature of approximately 120° C., and in the latter ironing case, it comes in contact with a high-temperature heater having a temperature of approximately 150° C.

Meanwhile, the heat-sensitive recording layer of a heat-sensitive recording material which forms a color under heat to record an image contains a color-forming substance and a color-developing substance which reacts with the color-forming substance to allow it to form a color under heat. The color-forming substance is selected, for example, from colorless or light-color leuco dyes having a lactone, lactam or spiropyran ring, and the color-developing substance is selected, for example, from various acidic substances such as 4,4'-isopropylidenediphenol, 4,4'-dihydroxydiphenylsulfone, 2,4'-dihydroxydiphenylsulfone, 4-hydroxy-4'-isopropoxydiphenylsulfone and 3,3'-diallyl-4,4'-dihydroxydiphenylsulfone.

Since color-formed images obtained from a combination of the above color-forming substance and the above color-developing substance have a clear color tone, the above combination has been applied to various heat-sensitive recording materials. Of the above color-developing substances, 4,4'-dihydroxydiphenylsulfone is advantageous in that it has a high whiteness and a formed color is clear, while it has defects that it has a very high melting point (246° C.) and that a heat-sensitive recording material is therefore poor in thermal response so that the so-called sensitivity thereof is low. The heat-sensitive recording material has inferior color formability when used with fast facsimile machines and various printers to which recent energy-saving techniques are applied. The heat-sensitive recording material is therefore limited in use, and its improvement is strongly desired.

For improving the color forming performances, it is general practice to add a so-called sensitizer such as 2-benzyloxynaphthalene which works as a melting point dropping agent for the color-developing substance. As the above sensitizer, 2-benzyloxynaphthalene, hydroxydiphenylsulfone derivatives and benzyl oxalate derivatives are studied in various ways, while no sufficient effects are obtained at present.

DISCLOSURE OF THE INVENTION

It is an object of the present invention to provide a heat-sensitive recording material having a heat-sensitive recording layer comprising an electron-donating dye precursor and an electron-accepting compound which reacts with the electron-donating dye precursor under heat to cause the precursor to form a color and having characteristic features that it has a high color-forming sensitivity (excellent thermal response) and exhibits a high formed color density, that it exhibits a decreased ground fogging and that it has excellent retainability of recorded images, or a heat-sensitive recording material as described above in which the electron-accepting compound is 4,4'-dihydroxydiphenylsulfone and which has high sensitivity and exhibits excellent color formability in printing.

The present inventors have made diligent studies for achieving the above object, and as a result, it has been found that the above object can be achieved by a heat-sensitive recording material using a combination of at least two diphenylsulfone derivatives as an electron-accepting compound, a heat-sensitive recording material having a heat-sensitive recording layer containing a diphenylsulfone derivative and a specific compound as an electron-accepting compound, a heat-sensitive recording material having a heat-sensitive recording layer containing a diphenylsulfone derivative as an electron-accepting compound and a specific compound as an additive, and a heat-sensitive recording material having a heat-sensitive recording layer containing 4,4'-dihydroxydiphenylsulfone as an electron-accepting compound and a combination of two specific compounds as an additive. The present invention has been accordingly completed on the basis of the above findings.

That is, according to the present invention, there are provided:

(1) a heat-sensitive recording material having a heat-sensitive recording layer containing an electron-donating dye precursor and an electron-accepting compound which reacts with the electron-donating dye precursor under heat to cause the electron-donating dye precursor to form a color, wherein the heat-sensitive recording layer contains a combination of at least two diphenylsulfone derivatives as the above electron-accepting compound (to be referred to as "heat-sensitive recording material I" hereinafter), (2) a heat-sensitive recording material having a heat-sensitive recording layer containing an electron-donating dye precursor and an electron-accepting compound which reacts with the electron-donating dye precursor under heat to cause the electron-donating dye precursor to form a color, wherein the heat-sensitive recording layer contains a diphenylsulfone derivative and a hydroxybenzoic acid derivative other than salicylamide and derivatives thereof, as an electron-accepting compound (to be referred to as "heat-sensitive recording material II" hereinafter), (3) a heat-sensitive recording material having a heat-sensitive recording layer containing an electron-donating dye precursor and an electron-accepting compound which reacts with the electron-donating dye precursor under heat to cause the electron-donating dye precursor to form a color, wherein the heat-sensitive recording layer contains a diphenylsulfone derivative as an electron-accepting compound and further contains a diphenyl ether derivative as an additive (to be referred to as "heat-sensitive recording material III" hereinafter), (4) a heat-sensitive recording material having a heat-sensitive recording layer containing an electron-donating dye precursor and an electron-accepting compound which reacts with the electron-donating dye precursor under heat to cause the electron-donating dye precursor to form a color, wherein the heat-sensitive recording layer contains a diphenylsulfone derivative as an electron-accepting compound and further contains salicylamide or a derivative thereof as an additive (to be referred to as "heat-sensitive recording material IV" hereinafter), and (5) a heat-sensitive recording material having a heat-sensitive recording layer containing an electron-donating dye precursor and an electron-accepting compound which reacts with the electron-donating dye precursor under heat to cause the electron-donating dye precursor to form a color, wherein the heat-sensitive recording layer contains 4,4'-dihydroxydiphenylsulfone as an electron-accepting compound and further contains salicylanilide and benzyloxalate as an additive (to be referred to as "heat-sensitive recording material V" hereinafter).

BEST MODES OF THE INVENTION

Each of the heat-sensitive recording materials I to V of the present invention has a heat-sensitive recording layer containing an electron-donating dye precursor and an electron-accepting compound which reacts with the electron-donating dye precursor under heat to cause the electron-donating dye precursor to form a color, and the heat-sensitive recording layer is formed on a substrate.

In the present invention, paper is mainly used as the above substrate. In addition to the paper, the substrate can be selected from various woven fabrics, non-woven fabrics, synthetic resin films, synthetic resin laminated papers, synthetic papers, metal foils, deposition sheets, or composite sheets obtained from combinations of these substrates by a laminating method or the like, as required.

The electron-donating dye precursor for use in the heat-sensitive recording layer of each heat-sensitive recording material is generally selected from colorless or light-color dye precursors, and is not specially limited in kind. It can be properly selected from those which are conventionally used as a dye precursor in conventional pressure-sensitive recording papers and heat-sensitive recording papers.

Although not specially limited, specific examples of the above dye precursor are as follows.

(1) Xanthene compounds: 3-dibytylamino-6-methyl-7-anilinofluoran, 3-dibutylamino-6-methyl-7-phenylaminofluoran, 3-dibutylamino-6-chloro-7-(o-chloroanilino)fluoran, 3-dibutylamino-6-methyl-7-(o-chloroanilino)fluorine, 3-dibutylamino-6-methyl-7-(o-fluoroanilino)fluoran, 3-dibutylamino-7-(o-chloroanilino)fluoran, 3-dibutylamino-7-(o-chlorobenzyl)aminofluoran, 3-dibutylamino-7-(o-fluoroanilino)fluoran, 3-diethylamino-6-methyl-7-anilinofluoran, 3-diethylamino-6-methyl-7-phenylaminofluoran, 3-diethylamino-6-methyl-7-xylidinofluoran, 3-diethylamino-6-methyl-7-benzylaminofluoran, 3-diethylamino-6-methyl-7-dibenzylaminofluoran, 3-diethylamino-6-methyl-7-n-octylaminofluoran, 3-diethylamino-6-methyl-7-(N-cyclohexyl-N-benzylamino)fluoran, 3-diethylamino-6-methyl-7-(o-chloroanilino)fluoran, 3-diethylamino-6-methyl-7-(o-trifluoromethylanilino)fluoran, 3-diethylamino-6-methyl-7-(m-trifluoromethylanilino)fluoran, 3-diethylamino-6-methyl-7-(o-ethoxyanilino)fluoran, 3-diethylamino-6-methyl-7-(p-ethoxyanilino)fluoran, 3-diethylamino-6-chloro-7-(o-chloroanilino)fluoran, 3-diethylamino-6-chloro-7-dibenzylaminofluoran, 3-diethylamino-6-chloro-7-anilinofluoran, 3-diethylamino-6-ethylethoxy-7-anilinofluoran, 3-diethylamino-7-anilinofluoran, 3-diethylamino-7-methylanilinofluoran, 3-diethylamino-7-dibenzylaminofluoran, 3-diethylamino-7-n-octylaminofluoran, 3-diethylamino-7-p-chloroanilinofluoran, 3-diethylamino-7-p-methylphenylanilinofluoran, 3-diethylamino-7-(N-cylcohexyl-N-benzyl)aminofluoran, 3-diethylamino-7-(o-chloroanilino)fluoran, 3-diethylamino-7-(o-chlorophenyl)aminofluoran, 3-diethylamino-7-(o-carbomethoxyphenyl)aminofluoran, 3-diethylamino-7-(m-trifluoroanilino)fluoran, 3-diethylamino-7-(o-trifluoromethylanilino)fluoran, 3-diethylamino-7-(o-ethoxyanilino)fluoran, 3-diethylamino-7-(p-ethoxyanilino)fluoran, 3-diethylamino-7-(o-chlorobenzylanilino)fluoran, 3-dimethylamino-6-chloro-7-dibenzylaminofluoran, 3-dimethylamino-6-chloro-7-n-octylaminofluoran, 3-dimethylamino-7-benzylaminofluoran, 3-dimethylamino-7-n-octylaminofluoran, 3-dibenzylamino-6-methyl-7-dibenzylaminofluoran, 3-dibenzylamino-7-dibenzylaminofluoran, 3-dibenzylamino-7-(o-chloroanilino)fluoran, 3-(N-methyl-N-n-hexyl)amino-7-anilinofluoran, 3-(N-methyl-N-cyclohexyl)amino-6-methyl-7-phenylaminofluoran, 3-(N-methyl-N-tetrahydrofurfuryl)amino-6-methyl-7-phenylaminofluoran, 3-(N-ethyl-N-n-propyl)amino-6-chloro-7-dibenzylaminofluoran, 3-(N-ethyl-N-n-propyl)amino-7-dibenzylaminofluoran, 3-(N-ethyl-N-isoamyl)amino-6-methyl-7-phenylaminofluoran, 3-(N-ethyl-N-cyclopentyl)amino-6-methyl-7-phenylaminofluoran, 3-(N-ethyl-N-n-hexyl)amino-7-anilinofluoran, 3-(N-ethyl-N-p-tolyl)amino-6-methyl-7-p-tolylaminofluoran, 3-(N-ethyl-N-p-tolyl)amino-6-methyl-7-phenylaminofluoran, 3-(N-ethyl-N-p-tolyl)amino-6-methyl-7-dibenzylaminofluoran, 3-(N-ethyl-N-p-tolyl)amino-6-methyl-7-(N-methyl-N-benzyl)aminofluoran, 3-(N-ethyl-N-p-tolyl)amino-7-(N-phenyl-N-methyl)aminofluoran, 3-(N-ethyl-N-p-tolyl)amino-7-dibenzylaminofluoran, 3-(N-ethyl-N-tetrahydrofurfuryl)amino-6-methyl-7-phenylaminofluoran, 3-(N-propyl-N-n-hexyl)amino-7-anilinofluoran, 3-(N-n-pentyl-N-allyl)amino-6-methyl-7-anilinofluoran, 3-(N-ethoxy-N-n-hexyl)amino-7-anilinofluoran, 3-[p-(p-anilinoanilino)anilino]-6-methyl-7-chlorofluoran, 3-pyrrolidino-6-methyl-7-phenylaminofluoran, 3-pyrrolidino-6-methyl-7-p-butylphenylaminofluoran, 3-pyrrolidino-7-dibenzylaminofluoran, 3-pyrrolidino-(7-cyclohexylanilino)fluoran, 3-piperidino-6-methyl-7-phenylaminofluoran, 3-anilino-7-dibenzylaminofluoran, 3-anilino-6-methyl-7-dibenzylaminofluoran, rhodamine B-anilinolactam, rhodamine B-(o-chloroanilino)lactam, rhodamine B-(p-nitroanilino)lactam, 3,6-bis(diethylaminofluoran)-γ-(4'-nitro)anilinolactam, 3-dibutylamino-6-methyl-7-chlorofluoran, 3-dibutylamino-6-methyl-7-bromofluoran, 3-dibutylamino-7,8-benzofluoran, 3-dibutylamino-7-chlorofluoran, 3-dibutylamino-7-methylfluoran, 3-diethylamino-5-methyl-7-dibenzylaminofluoran, 3-diethylamino-5-methyl-7-dibenzylaminofluoran, 3-diethylamino-6-methyl-7-chlorofluoran, 3-diethylamino-6-methoxyfluoran, 3-diethylamino-6-methylfluoran, 3-diethylamino-6-methyl-7-chloro-8-benzylfluoran, 3-diethylamino-6,7-dimethylfluoran, 3-diethylamino-6,8-diemthylfluoran, 3-diethylamino-7-chlorofluoran, 3-diethylamino-7-methoxyfluoran, 3-diethylamino-7-(N-acetyl-N-methyl)aminofluoran, 3-diethylamino-7-methylfluoran, 3-diethylamino-7-methylethoxyfluoran, 3-diethylamino-7-p-methylphenylfluoran, 3-diethylamino-7,8-benzofluoran, 3-diethylaminobenzo[a]fluoran, 3-diethylaminobenzo[c]fluoran, 3-dimethylamino-7-methoxyfluoran, 3-dimethylamino-6-methyl-7-chlorofluoran, 3-dimethylamino-7-methylfluoran, 3-dimethylamino-7-chlorofluoran, 3-diallylamino-7,8-benzofluoran, 3-diallylamino-7-chlorofluoran, 3-(N-ethyl-p-toluidino)-7-methylfluoran, 3-(N-ethyl-N-isoamyl)amino-6-methyl-7-chlorofluoran, 3-(N-ethyl-N-isoamyl)amino-7,8-benzofluoran, 3-(N-ethyl-N-isoamyl)amino-7-methylfluoran, 3-(N-ethyl-N-n-octyl)amino-6-methyl-7-chlorofluoran, 3-(N-ethyl-N-n-octyl)amino-7,8-benzofluoran, 3-(N-ethyl-N-n-octyl)amino-7-methylfluoran, 3-(N-ethyl-N-n-octyl)amino-7-chlorofluoran, 3-(N-ethyl-N-4-methylphenyl)amino-7,8-benzofluoran, 3-(N-ethyl-N-4-methylphenyl)amino-7-methylfluoran, 3-(N-isopentyl-N-ethyl)amino-7,8-benzofluoran, 3-(N-ethoxyethyl-N-ethyl)amino-7,8-benzofluoran, 3-(N-ethoxyethyl-N-ethyl)amino-7-chlorofluoran, 3-cyclohexylamino-6-chlorofluoran, 3-pyrrolidylamino-7-methylfluoran, 3-ethylamino-7-methylfluoran, 3,6-dimethoxyfluoran, etc.

(2) Triarylmethane compounds: 3,3-bis(4-diethylamino-2-ethoxyphenyl)-4-azaphthalide, 3,6-bis(dimethylamino)fluorene-9-spiro-3'-(6'-dimethylamino)pthalide, 3-(1-ethyl-2-methylindol-3-yl)-3-(2-methyl-4-diethylaminophenyl)-4-azaphthalide, 3-(1-ethyl-2-methylindol-3-yl)-3-(2-ethoxy-4-aminophenyl)-4-azaphthalide, 3-(1-ethyl-2-methylindol-3-yl)-3-(2-ethoxy-4-methylaminophenyl)-4-azaphthalide, 3-(1-ethyl-2-methylindol-3-yl)-3-(2-ethoxy-4-ethylaminophenyl)-4-azaphthalide, 3-(1-ethyl-2-methylindol-3-yl)-3-(2-ethoxy-4-dimethylaminophenyl)-4-azaphthalide, 3-(1-ethyl-2-methylindol-3-yl)-3-(2-ethoxy-4-diethylaminophenyl)-4-azaphthalide, 3-(1-ethyl-2-methylindol-3-yl)-3-(2-ethoxy-4-dipropylaminophenyl)-4-azaphthalide, 3-(1-ethyl-2-methylindol-3-yl)-3-(2-ethoxy-4-dibutylaminophenyl)-4-azaphthalide, 3-(1-ethyl-2-methylindol-3-yl)-3-(2-ethoxy-4-dipentylaminophenyl)-4-azaphthalide, 3-(1-ethyl-2-methylindol-3-yl)-3-(2-ethoxy-4-dihexylaminophenyl)-4-azaphthalide, 3-(1-ethyl-2-methylindol-3-yl)-3-(2-ethoxy-4-dihydroxyaminophenyl)-4-azaphthalide, 3-(1-ethyl-2-methylindol-3-yl)-3-(2-ethoxy-4-dichloroaminophenyl)-4-azaphthalide, 3-(1-ethyl-2-methylindol-3-yl)-3-(2-ethoxy-4-dibromoaminophenyl)-4-azaphthalide, 3-(1-ethyl-2-methylindol-3-yl)-3-(2-ethoxy-4-diallylaminophenyl)-4-azaphthalide, 3-(1-ethyl-2-methylindol-3-yl)-3-(2-ethoxy-4-dihydroxyaminophenyl)-4-azaphthalide, 3-(1-ethyl-2-methylindol-3-yl)-3-(2-ethoxy-4-dimethoxyaminophenyl)-4-azaphthalide, 3-(1-ethyl-2-methylindol-3-yl)-3-(2-ethoxy-4-diethoxyaminophenyl)-4-azaphthalide, 3-(1-ethyl-2-methylindol-3-yl)-3-(2-ethoxy-4-dicyclohexylaminophenyl)-4-azaphthalide, 3-(1-ethyl-2-methylindol-3-yl)-3-(2-ethoxy-4-dimethylethoxyaminophenyl)-4-azaphthalide, 3-(1-ethyl-2-methylindol-3-yl)-3-(2-ethoxy-4-diethylethoxyaminophenyl)-4-azaphthalide, 3-(1-ethyl-2-methylindol-3-yl)-3-(2-ethoxy-4-diethylbutoxyaminophenyl)-4-azaphthalide, 3-(1-ethyl-2-methylindol-3-yl)-3-(2-ethoxy-4-dimethylcyclohexylaminophenyl)-4-azaphthalide, 3-(1-ethyl-2-methylindol-3-yl)-3-(2-ethoxy-4-dimethoxycyclohexylaminophenyl)-4-azaphthalide, 3-(1-ethyl-2-methylindol-3-yl)-3-(2-ethoxy-4-pyrrolidylaminophenyl)-4-azaphthalide, 3-(1-ethyl-2-methylindol-3-yl)-3-(3-ethoxy-4-diethylaminophenyl)-4-azaphthalide, 3-(1-ethyl-2-methylindol-3-yl)-3-(2,3-diethoxy-4-diethylaminophenyl)-4-azaphthalide, 3-(1-ethyl-2-methylindol-3-yl)-3-(4-diethylaminophenyl)-4-azaphthalide, 3-(1-ethyl-2-methylindol-3-yl)-3-(2-chloro-4-diethylaminophenyl)-4-azaphthalide, 3-(1-ethyl-2-methylindol-3-yl)-3-(3-chloro-4-diethylaminophenyl)-4-azaphthalide, 3-(1-ethyl-2-methylindol-3-yl)-3-(2-bromo-4-diethylaminophenyl)-4-azaphthalide, 3-(1-ethyl-2-methylindol-3-yl)-3-(3'-bromo-4-diethylaminophenyl)-4-azaphthalide, 3-(1-ethyl-2-methylindol-3-yl)-3-(2-ethyl-4-diethylaminophenyl)-4-azaphthalide, 3-(1-ethyl-2-methylindol-3-yl)-3-(2-propyl-4-diethylaminophenyl)-4-azaphthalide, 3-(1-ethyl-2-methylindol-3-yl)-3-(3-methyl-4-diethylaminophenyl)-4-azaphthalide, 3-(1-ethyl-2-methylindol-3-yl)-3-(2-nitro-4-diethylaminophenyl)-4-azaphthalide, 3-(1-ethyl-2-methylindol-3-yl)-3-(2-allyl-4-diethylaminophenyl)-4-azaphthalide, 3-(1-ethyl-2-methylindol-3-yl)-3-(2-hydroxy-4-diethylaminophenyl)-4-azaphthalide, 3-(1-ethyl-2-methylindol-3-yl)-3-(2-cyano-4-diethylaminophenyl)-4-azaphthalide, 3-(1-ethyl-2-methylindol-3-yl)-3-(2-cyclohexylethoxy-4-diethylaminophenyl)-4-azaphthalide, 3-(1-ethyl-2-methylindol-3-yl)-3-(2-methylethoxy-4-diethylaminophenyl)-4-azaphthalide, 3-(1-ethyl-2-methylindol-3-yl)-3-(2-cyclohexylethyl-4-diethylaminophenyl)-4-azaphthalide, 3-(1-ethyl-2-ethylindol-3-yl)-3-(2-ethoxy-4-diethylaminophenyl)-4-azaphthalide, 3-(1-ethyl-2-chloroindol-3-yl)-3-(2-ethoxy-4-diethylaminophenyl)-4-azaphthalide, 3-(1-ethyl-2-bromoindol-3-yl)-3-(2-ethoxy-4-diethylaminophenyl)-4-azaphthalide, 3-(1-ethyl-2-ethylindol-3-yl)-3-(2-ethoxy-4-diethylaminophenyl)-4-azaphthalide, 3-(1-ethyl-2-propylindol-3-yl)-3-(2-ethoxy-4-diethylaminophenyl)-4-azaphthalide, 3-(1-ethyl-2-methoxyindol-3-yl)-3-(2-ethoxy-4-diethylaminophenyl)-4-azaphthalide, 3-(1-ethyl-2-ethoxyindol-3-yl)-3-(2-ethoxy-4-diethylaminophenyl)-4-azaphthalide, 3-(1-ethyl-2-phenylindol-3-yl)-3-(2-ethoxy-4-diethylaminophenyl)-4-azaphthalide, 3-(1-ethyl-2-methylindol-3-yl)-3-(2-ethoxy-4-diethylaminophenyl)-7-azaphthalide, 3-(1-ethyl-2-methylindol-3-yl)-3-(2-ethoxy-4-diethylaminophenyl)-4,7-diazaphthalide, 3-(1-ethyl-4,5,6,7-tetrachloro-2-methylindol-3-yl)-3-(2-ethoxy-4-diethylaminophenyl)-4-azaphthalide, 3-(1-ethyl-4-nitro-2-methylindol-3-yl)-3-(2-ethoxy-4-diethylaminophenyl)-4-azaphthalide, 3-(1-ethyl-4-methoxy-2-methylindol-3-yl)-3-(2-ethoxy-4-diethylaminophenyl)-4-azaphthalide, 3-(1-ethyl-4-methylamino-2-methylindol-3-yl)-3-(2-ethoxy-4-diethylaminophenyl)-4-azaphthalide, 3-(1-ethyl-4-methyl-2-methylindol-3-yl)-3-(2-ethoxy-4-diethylaminophenyl)-4-azaphthalide, 3-(2-methylindol-3-yl)-3-(2-ethoxy-4-diethylaminophenyl)-4-azaphthalide, 3-(1-chloro-2-methylindol-3-yl)-3-(2-ethoxy-4-diethylaminophenyl)-4-azaphthalide, 3-(1-bromo-2-methylindol-3-yl)-3-(2-ethoxy-4-diethylaminophenyl)-4-azaphthalide, 3-(1-methyl-2-methylindol-3-yl)-3-(2-ethoxy-4-diethylaminophenyl)-4-azaphthalide, 3-(1-methyl-2-methylindol-3-yl)-3-(2-ethoxy-4-diethylaminophenyl)-7-azaphthalide, 3-(1-propyl-2-methylindol-3-yl)-3-(2-ethoxy-4-diethylaminophenyl)-4-azaphthalide, 3-(1-butyl-2-methylindol-3-yl)-3-(2-ethoxy-4-diethylaminophenyl)-4-azaphthalide, 3-(1-butyl-2-methylindol-3-yl)-3-(2-ethoxy-4-diethylaminophenyl)-7-azaphthalide, 3-(1-pentyl-2-methylindol-3-yl)-3-(2-ethoxy-4-diethylaminophenyl)-4-azaphthalide, 3-(1-hexyl-2-methylindol-3-yl)-3-(2-ethoxy-4-diethylaminophenyl)-4-azaphthalide, 3-(1-hexyl-2-methylindol-3-yl)-3-(2-ethoxy-4-diethylaminophenyl)-7-azaphthalide, 3-(1-octyl-2-methylindol-3-yl)-3-(2-ethoxy-4-diethylaminophenyl)-4-azaphthalide, 3-(1-octyl-2-methylindol-3-yl)-3-(2-ethoxy-4-diethylaminophenyl)-7-azaphthalide, 3-(1-octyl-2-methylindol-3-yl)-3-(2-ethoxy-4-diethylaminophenyl)-4,7-diazaphthalide, 3-(1-nonyl-2-methylindol-3-yl)-3-(2-ethoxy-4-diethylaminophenyl)-4-azaphthalide, 3-(1-methoxy-2-methylindol-3-yl)-3-(2-ethoxy-4-diethylaminophenyl)-4-azaphthalide, 3-(1-ethoxy-2-methylindol-3-yl)-3-(2-ethoxy-4-diethylaminophenyl)-4-azaphthalide, 3-(1-phenyl-2-methylindol-3-yl)-3-(2-ethoxy-4-diethylaminophenyl)-4-azaphthalide, 3-(1-pentyl-2-methylindol-3-yl)-3-(2-ethoxy-4-diethylaminophenyl)-7-azaphthalide, 3-(1-heptyl-2-methylindol-3-yl)-3-(2-ethoxy-4-diethylaminophenyl)-7-azaphthalide, 3-(1-nonyl-2-methylindol-3-yl)-3-(2-ethoxy-4-diethylaminophenyl)-7-azaphthalide, 3,3-bis(p-dimethylaminophenyl)-6-dimethylaminophthalide, 3-(4-dimethylamino-2-methylphenyl)-3-(4-dimethylaminophenyl)-6-dimethylaminophthalide, 3-(1-ethyl-2-methylindol-3-yl)-3-(4-diethylamino-2-n-hexyloxyphenyl)-4-azaphthalide, 3-(1-ethyl-2-methylindol-3-yl)-3-(4-diethylaminophenyl) phthalide, 3,3-bis(1-n-butyl-2-methylindol-3-yl)phthalide, 3,3-bis(1-n-butyl-2-methylindol-3-yl)tetrachlorophthalide, 3,3-bis(1-n-butylindol-3-yl)phthalide, 3,3-bis(1-n-pentyl-2-methylindol-3-yl)phthalide, 3,3-bis(1-n-hexyl-2-methylindol-3-yl)phthalide, 3,3-bis(1-n-octyl-2-methylindol-3-yl)phthalide, 3,3-bis(1-methyl-2-methylindol-3-yl)phthalide, 3,3-bis(1-ethyl-2-methylindol-3-yl)phthalide, 3,3-bis(1-propyl-2-methylindol-3-yl) phthalide, 3,3-bis(2-methylindol-3-yl)phthalide, etc.

(3) Diphenylmethane compounds: 4,4'-bis (dimethylaminophenyl)benzhydrylbenzyl ether, N-chlorophenyl leuco-Auramine, N-2,4,5-trichlorophenyl leuco-Auramine, etc.

(4) Thiazine compounds: Benzoyl leucomethylene blue, p-nitrobenzoyl leucomethylene blue, etc.

(5) Spiro compounds: 3-methylspirodinaphthopyran, 3-ethylspirodinaphthopyran, 3,3'-dichlorospirodinaphthopyran, 3-benzylspironaphthopyran, 3-methylnaphtho-(3-methoxybenzo)spiropyran, 3-propylspirobenzopyran, etc.

The above dye precursors may be used alone or in combination. Of the above dye precursors, preferred are those having a melting point of 200° C. or lower such as 3-dibutylamino-6-methyl-7-anilinofluoran, since a heat-sensitive recording material having high color-forming sensitivity can be obtained.

First, the heat-sensitive recording material I of the present invention will be explained.

In the heat-sensitive recording material I of the present invention, the heat-sensitive recording layer contains a combination of at least two diphenylsulfone derivatives as an electron-accepting compound which causes the above dye precursor to form a color.

The above diphenylsulfone derivatives are selected, for example, from compounds of the formula (I), (I)

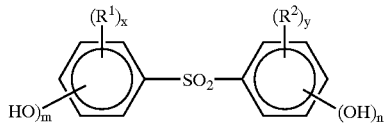

wherein each of $R^1$ and $R^2$ is independently halogen, alkyl, alkenyl, aralkyl, aryl, alkoxyl, aralkyloxy or phenylsulfonyl, m is an integer of 1 to 4, n is an integer of 0 to 4, and each of x and y is an integer of 0 to 2.

Specific examples of the above compounds of the formula (I) include 4-hydroxy-4'-isopropoxydiphenylsulfone, 4-hydroxy-4'-n-propoxydiphenylsulfone, 4,4'-dihydroxydiphenylsulfone, 2,4'-dihydroxydiphenylsulfone, 4-hydroxydiphenylsulfone, 4-hydroxy-4'-methyldiphenylsulfone, 4-hydroxy-4'-methoxydiphenylsulfone, 4-hdyroxy-4'-ethoxydiphenylsulfone, 4-hydroxy-4'-n-butoxydiphenylsulfone, 4-hydroxy-4'-benzyloxydiphenylsulfone, 3,3-diallyl-4,4'-dihydroxy-diphenylsulfone, bis(3,3',5,5'-tetrabromo-4-hydroxyphenyl)sulfone, bis(3,3',5,5'-tetrachloro-4-hydroxyphenyl)sulfone, 3,4-dihydroxydiphenylsulfone, 3,4-dihydroxy-4'-methyldiphenylsulfone, 3,4,4'-trihydroxydiphenylsulfone, 3,4-tetrahydroxydiphenylsulfone and 2,3,4-trihydroxydiphenylsulfone. The diphenylsulfone derivatives used in the present invention shall not be limited to these.

When at least two diphenylsulfone derivatives having different properties are used in combination, the diphenylsulfone derivatives compensate each other for their defects due to their excellent compatibility with each other since they have similar structures. These diphenylsulfone derivatives can serve to materialize a high color-forming sensitivity and a high saturation concentration (color density) due to their synergistic effects, and these compounds can prevent ground fogging against heat and humidity.

Of the above diphenylsulfone derivatives, it is particularly preferred to use 4-hydroxy-4'-isopropoxydiphenylsulfone and 4-hydroxy-4'-n-propoxydiphenylsulfone in combination.

4-Hydroxy-4'-isopropoxydiphenylsulfone is excellent over 4-hydroxy-4'-n-propoxydiphenylsulfone in the recorded image retainability of a heat-sensitive recording material, while 4-hydroxy-4'-isopropoxydiphenylsulfone is inferior to 4-hydroxy-4'-n-propoxydiphenylsulfone in achieving a high color-forming sensitivity and a high saturation concentration. On the other hand, 4-hyrdroxy-4'-n-propoxydiphenylsulfone is not so easily hydrated as 4-hydoxy-4'-isopropoxydiphenylsulfone, and is excellent over 4-hydoxy-4'-isopropoxydiphenylsulfone in achieving color forming-sensitivity and saturation concentration, while 4-hyrdroxy-4'-n-propoxydiphenylsulfone is inferior in achieving high retainability of recorded images.

When the above 4-hydroxy-4'-isopropoxydiphenylsulfone and 4-hydroxy-4'-n-propoxydiphenylsulfone are used in combination, these compounds compensate each other for their defects without impairing their advantages found when one of them is used alone. Further, since these compounds have similar structures, they have high compatibility with each other, and they serve to obtain a heat-sensitive recording material which shows a decreased ground fogging against heat and temperatures while materializing a specifically high color-forming sensitivity and saturation concentration and which has excellent retainability of recorded images against chemicals and light.

The amount ratio of 4-hydroxy-4'-isopropoxydiphenylsulfone and 4-hydroxy-4'-n-propoxydiphenylsulfone is preferably that 4-hydroxy-4'-n-propoxydiphenylsulfone is used in an amount of at least 5% by weight based on 4-hydroxy-4'-isopropoxydiphenylsulfone. When the content of 4-hydroxy-4'-n-propoxydiphenylsulfone is less than 5% by weight, it is difficult to achieve a high color-forming sensitivity and saturation concentration.

In the heat-sensitive recording material I of the present invention, it is also preferred to use a combination of 4,4'-dihydroxydiphenylsulfone with at least two other diphenylsulfone derivatives as an electron-accepting compound.

The above "at least two other" diphenylsulfone derivatives are selected, for example, from compounds of the formula (II),

II

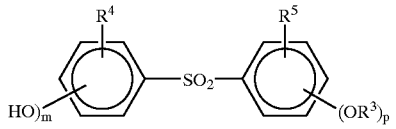

wherein $R^3$ is hydrogen, alkyl, alkenyl, aralkyl or aryl, each of $R^4$ and $R^5$ is independently hydrogen, halogen, alkyl, alkenyl, aralkyl, aryl or phenylsulfonyl, and each of m and p is an integer of 1 to 4, provided that 4,4'-dihydroxydiphenylsulfone is not included in the compounds of the formula (II).

When 4,4'-dihydroxydiphenylsulfone is used as described above, there can be obtained a heat-sensitive recording material which shows improved retainability of an image portion, particularly, improved retainability against heat.

Further, when 4,4'-dihydroxydiphenylsulfone is used in combination of at least two other diphenylsulfone derivatives of the above formula (II), there can be obtained a heat-sensitive recording material which shows high thermal response and which further has excellent retainability of an image portion against temperatures and humidity.

Specific examples of the diphenylsulfone derivatives of the above formula (II) excluding 4,4'-dihydroxdiphenylsulfone include 4-hydroxy-4'-isopropoxydiphenylsulfone, 4-hydroxy-4'-n-propoxyphenylsulfone, 2,4'-dihydroxydiphenylsulfone, 4-hydroxy-4'-methoxydiphenylsulfone, 4-hydroxy-4'-ethoxydiphenylsulfone, 4-hydroxy-4'-n-butoxydiphenylsulfone, diphenyl 4-hydroxy-4'-benzyloxydiphenylsulfone, 3,3'-diallyl-4,4'-dihydroxy-diphenyl sulfone, bis(3,5-dibromo-4-hydroxyphenyl)sulfone, bis(3,5-dicyclo-4-hydroxyphenyl) sulfone, 3,4,4'-trihydroxydiphenylsulfone, 3,4,3,',4'-tetrahydroxydiphenylsulfone and 3,3'-diallyl-4,4'-dihydroxydiphenylsulfone, although the diphenylsulfone derivatives shall not be limited thereto.

When the above "at least two other" diphenylsulfone derivatives other than 4,4'-dihydroxydiphenylsulfone are selected from the following five compounds of the above-described compounds, such as 4-hydroxy-4'-benzyloxydiphenylsulfone, 4-hydroxy-4'-isopropoxydiphenylsulfone, 2,4'-dihydroxydiphenylsulfone, 3,3'-diallyl-4,4'-dihydroxydiphenylsulfone and 4-hydroxy-4'-n-propoxydiphenylsulfone, preferably, there can be obtained a heat-sensitive recording material having well-balanced product properties concerning thermal response, saturation concentration and retainability of an image portion including freedom from ground fogging.

In this case, at least two other diphenylsulfone derivatives other than 4,4'-dihydroxydiphenylsulfone are used. When one of the above diphenylsulfone derivatives is used alone in combination with 4,4'-dihyroxydiphenylsulfone, a heat-sensitive recording material may be poor in thermal response. When two or three compounds of the above diphenylsulfone derivatives are used, there can be obtained a heat-sensitive recording material which exhibits practically sufficient thermal response while maintaining the retainability of an image portion including the freedom from ground fogging. When the number of the above diphenylsulfone derivatives is further increased, a heat-sensitive recording material is further improved in thermal response, while ground fogging is liable to occur easily, so that it is necessary to give full attention to a balance of product properties. It is assumed that the thermal response is improved to a greater extent as the number of the diphenylsulfone derivatives increases because of a melting point drop caused by mixing substances.

When a combination of 4-benzyloxy-4'-hydroxydiphenylsulfone, 4-hydroxy-4'-isorpoxydiphenylsulfone and 2,4'-dihydroxydiphenylsulfone or a combination of 4-benzyloxy-4'-hydroxydiphenylsulfone, 2,4'-dihydroxydiphenylsulfone and 3,3'-diallyl-4,4'-dihydroxydiphenylsulfone is used as at least two other diphenylsulfone derivatives other than 4,4'-dihydroxydiphenylsulfone, desirably, there can be obtained a heat-sensitive recording material having a well-balanced properties among thermal response, saturation concentration and retainability of an image portion including freedom from ground fogging.

When a combination of 4,4'-dihydroxydiphenylsulfone with at least two other diphenylsulfone derivatives is used as an electron-accepting compound, the content of 4,4'-dihydroxydiphenylsulfone in the total electron-accepting compound amount is preferably in-the range of from 25 to 75% by weight. When the above content of 4,4'-dihydroxydiphenylsulfone exceeds 75% by weight, it is difficult to achieve excellent thermal response. When it is less than 25% by weight, it is difficult to achieve sufficient retainability of an image portion including freedom from ground fogging.

Further, when the contents of the "at least two other diphenylsulfone derivatives" are equivalent to each other or one another by weight ratio, there can be obtained a heat-sensitive recording material improved in thermal response to the greatest extent.

In the thermal-sensitive recording material I, other electron-accepting compound can be used as required in combination with the above various diphenylsulfone derivatives so long as the effects of the present invention are not impaired. Although not specially limited, the above electron-accepting compound that can be used in combination is typified by acidic substances generally used in pressure-sensitive recording materials or heat-sensitive recording materials. For example, the above electron-accepting compound includes phenol derivatives, aromatic carboxylic acid derivatives, N,N'-diarylthiourea derivatives and polyvalent metal salts such as zinc salts of organic compounds.

Although not specially limited, specific examples of the above electron-accepting compound that can be used in combination include p-phenylphenol, p-hydroxyacetophenone, 1,1-bis(p-hydroxyphenyl)propane, 1,1-bis(p-hydroxyphenyl)pentane, 1,1-bis(p-hydroxyphenyl)hexane, 1,1-bis(p-hydroxyphenyl)cyclohexane, 2,2-bis(p-hydroxyphenyl)propane, 2,2-bis(p-hydroxyphenyl)hexane, 1,1-bis(p-hydroxyphenyl)-2-ethylhexane, 2,2-bis(3-chloro-4-hydroxyphenyl)propane, 1,1-bis(p-hydroxyphenyl)-1-phenylethane, 1,3-di-[2-(p-hydroxyphenyl)-2-propyl] benzene, 1,3-di-[2-(3,4-dihydroxyphenyl)-2-propyl] benzene, 1,4-di-[2-(p-hydroxyphenyl)-2-propyl]benzene, 4,4'-dihydroxydiphenyl ether, 3,3'-chloro-4,4'-dihydroxydiphenylsulfide, methyl 2,2-bis(4-hydroxyphenyl)acetate, butyl 2,2-bis(4-hydroxyphenyl) acetate, 4,4'-thiobis(2-tert-butyl-5-methylphenol), benzyl p-hydroxybenzoate, chlorobenzyl p-hydroxybenzoate, dimethyl 4-hydroxyphthalate, benzyl gallate, stearyl gallate, salicylanilide, 5-chlorosalicylanilide, salicylic acid, 3,5-di-tert-butylsalicylic acid, 3,5-di-α-methylbenzylsalicylic acid, 4-[2'-(4-methoxyphenoxy)ethyloxy]salicylic acid, and metal salts of these salicylic acid derivatives.

In the heat-sensitive recording material I of the present invention, the heat-sensitive recording layer may contain a heat-meltable substance as required for improving the thermal response thereof. The heat-meltable substance preferably has a melting point of 60 to 180° C., more preferably 80 to 140° C. Specific examples of the heat-meltable substance include amides such as N-hydroxymethylstearic acid amide, stearic acid amide, palmitic acid amide, oleic acid amide, ethylenebisstearic acid amide, N-stearylstearic acid amide, methylenebis-hydrogenated beef tallow fatty acid amide and ricinolic acid amide; synthetic and natural waxes such as paraffin wax, microcrystalline wax, polyethylene wax and carnauba wax; naphthol derivatives such as benzyl-2-naphthyl ether; biphenyl derivatives such as p-benzylbiphenyl and 4-allyloxybiphenyl; polyether compounds such as 1,2-bis(3-methylphenoxy)ethane, 2,2'-bis(4-methoxyphenoxy)diethyl ether, bis(methoxyphenoxy)ether, α,α'-diphenoxyxylene; esters such as diphenyl carbonate, diphenyl adipate, dibenzyl oxalate, di(p-methylbenzyl) oxalate, di(4-chlorobenzyl)oxalate, dimethyl terephthalate, dibenzyl terephthalate and phenyl benzenesulfonate; and others such as N-stearylurea, m-terphenyl, 4-acetylacetone, acetoacetic acid anilides and fatty acid anilides. The above compounds may be used alone or in combination. For achieving sufficient thermal response, the content of the heat-meltable substance in the total solid amount of the heat-sensitive recording layer is preferably 5 to 50% by weight.

The heat-sensitive recording material II of the present invention will be explained hereinafter.

In the heat-sensitive recording material II of the present invention, the heat-sensitive recording layer contains as an electron-accepting compound, a diphenylsulfone derivative and a hydroxybenzoic acid derivative other than salicylamide and derivatives thereof.

The above diphenylsulfone derivative is selected, for example, from those compounds of the above formula (II). Specific examples of the compounds of the formula (II) include 4,4'-dihydroxydiphenylsulfone and those compounds specified as examples of the compounds of the formula (II) in the explanation of the heat-sensitive recording material I. Those diphenylsulfone derivatives may be used alone or in combination.

Of the above diphenylsulfone derivatives, 4,4'-dihydroxydiphenylsulfone or 2,4'-dihydroxydiphenylsulfone is preferably used, since a heat-sensitive recording material is excellent in retainability of an image portion, particularly retainability against heat over a heat-sensitive recording material using any other diphenylsulfone derivative.

Since the above diphenylsulfone derivative and a hydroxybenzoic acid derivative other than salicylamide and derivatives thereof are used in combination, the heat-sensitive recording material II of the present invention shows higher thermal response and has excellent retainability of an image portion against temperatures and humidity.

The above hydroxybenzoic acid derivative can be selected, for example, from compounds of the formula (III),

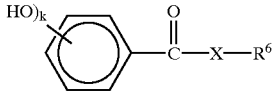

(III)

wherein X is oxygen or NH, $R^6$ is alkyl, alkenyl, aralkyl or aryl, and k is an integer of 1 to 4, provided that the compounds of the formula (III) exclude salicylamide and derivatives thereof.

Specific examples of the benzoic acid derivatives of the formula (III) excluding salicylamide and derivatives thereof include ethyl 4-hydroxybenzoate, propyl 4-hydroxybenzoate, butyl 4-hydroxybenzoate and benzyl 4-hydroxybenzoate. These derivatives may be used alone or in combination. Of these, benzyl 4-hydroxybenzoate is particularly preferred.

In the heat-sensitive recording material II of the present invention, the weight ratio of the diphenylsulfone derivative and the above hydroxybenzoic acid derivative (diphenylsulfone derivative/hydroxybenzoic acid derivative) is preferably 1/2 to 5/1. When the content of the diphenylsulfone derivative is too large, or in other words, when the content of the hydroxybenzoic acid derivative is too small, it is difficult to achieve excellent thermal response. Further, when each of the above contents is the reverse, it is difficult to achieve sufficient retainability of an image portion, and an image portion is liable to show a decrease in density during a heat durability test. Further, a fine crystal is liable to occur in an image portion surface, and as a result, the image portion is liable to become cloudy in tone to cause a decrease in density, and a product quality defect called "powdering" is liable to occur. For achieving good thermal response and good retainability of an image portion, the diphenylsulfone derivative/hydroxybenzoic acid derivative weight ratio is 1/2 to 5/1, and for achieving far better results, the above weight ratio is 1/1 to 5/1.

In the heat-sensitive recording material II, further, it is preferred to incorporate a phosphate ester derivative as an additive to the heat-sensitive recording layer. In this case, there can be obtained a heat-sensitive recording material which has practically higher thermal response and has further improved retainability of an image portion. The reason therefor is assumed to be that the phosphate ester derivative present in the vicinity of the electron-accepting compound improves the compatibility of the dye precursor and the electron-accepting compound.

Specific examples of the phosphate ester derivative include diphenylhydrogen phosphate, bis(4-tert-butylphenyl)hydrogen phosphate, bis(4,6-di-tert-butylphenyl)hydrogen phosphate, bis(4-chlorophenyl) hydrogen phosphate, bis(benzyloxyphenyl)hydrogen phosphate, 2,2'-methylenebis(4,6-di-tert-butylphenyl) hydrogen phosphate, dimethylhydrogen phosphate, diethylhydrogen phosphate and bis(3,5-di-tert-butyl-4-hydroxyphenyl)hydrogen phosphate, although the phosphate ester derivative shall not be limited thereto. The above phosphate ester derivatives may be used alone or in combination.

Of the above phosphate ester derivatives, 2,2'-methylenebis(4,6-di-tert-butylphenyl)hydrogen phosphate is preferred.

The amount of the above phosphate ester derivative based on the electron-accepting compound is preferably 1 to 100% by weight, more preferably 3 to 50% by weight.

When the amount of the phosphate ester derivative is less than 1% by weight based on the electron-accepting compound, the effect on improvements of the thermal response and the retalnability of an image portion may be insufficient. When the above amount exceeds 100% by weight, the contact of the electron-donating dye precursor and the electron-accepting compound comes to be inhibited, and the thermal response may rather decrease.

In the heat-sensitive recording material II of the present invention, it is preferred to incorporate a phenol derivative (other than the diphenylsulfone derivative and the hydroxybenzoic acid derivative) into the heat-sensitive recording layer for improving the heat-sensitive recording material in retainability of an image portion, particularly, water resistance of an image portion. In this case, there can be obtained a heat-sensitive recording material having practically higher retainability of an image portion, practically higher water resistance of an image portion in particular.

Specific examples of the above phenol derivative include triethylene glycol-bis[3-(3-tert-butyl-5-methyl-4-hydroxyphenyl)propionate], 1,6-hexanediolbis[3-(3,5-di-tert-butyl-4-hydroxyphenyl)propionate], 2,4-bis(n-octylthio)-6-(4-hydroxy-3,5-di-tert-butylanilino)-1,3,5-triazine, pentaerythrityl-tetrakis[3,(3,5-di-tert-butyl-4-hydroxyphenyl)propionate], 2,2,-thio-diethylene-bis[3-(3,5-di-tert-butyl-4-hydroxyphenyl)propionate], octadecyl-3-(3,5-di-tert-butyl-4-hydroxyphenyl)propionate, N,N'-hexamethylenebis(3,5-di-tert-butyl-4-hydroxyhydrocinnamide), 3,5-di-tert-butyl-4-hydroxybenzylsulfonate-diethyl ester, 1,3,5-trimethyl-2,4,6-tris(3,5-di-tert-butyl-4-hydroxybenzyl)benzene, tris(3,5-di-tert-butyl-4-hydroxybenzyl)-isocyanurate, 4,4'-butylidene-bis(6-tert-butyl-m-cresol), 2,2'-methylene-bis(4-methyl-6-tert-butylphenol), 2,2'-methylene-bis(4-ethyl-6-tert-butylphenol), 2,5-di-tert-amylhydroquinone, 2,5-di-tert-butylhydroquinone, 4,4'-thiobis(6-tert-butyl-m-cresol), styrenated phenol, and 2,6-di-tert-butyl-p-cresol, The above phenol derivatives may be used alone or in combination.

The amount of the phenol derivative based on the electron-accepting compound is preferably 1 to 100% by weight, more preferably 5 to 50% by weight.

When the amount of the phenol derivative is less than 1% by weight based on the electron-accepting compound, the effect of improving the retainability of an image portion may be insufficient. When the above amount exceeds 100% by weight, the contact of the electron-donating dye precursor and the electron-accepting compound comes to be inhibited, and undesirably, the thermal response and the maximum density of an image portion may decrease.

In the heat-sensitive recording material II, it is also preferred to use, as an electron-accepting compound, a combination of a diphenylsulfone derivative of the formula (IV),

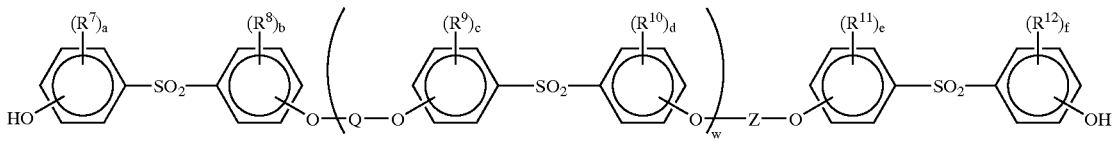

(IV)

wherein each of Q and Z is independently a saturated or unsaturated divalent hydrocarbon which has 1 to 12 carbon atoms and may have an ether bond,

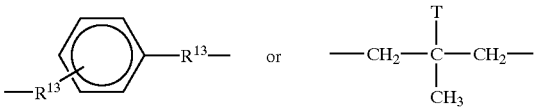

wherein $R^{13}$ is a methylene or ethylene group, T is hydrogen or a $C_1$–$C_4$ alkyl group, each of $R^7$ to $R^{12}$ is independently halogen, alkyl or alkenyl, each of a, b, c, d, e and f is an integer of 0 to 4 and w is an integer of 0 to e and f is an integer of 0 to 4 and w is an integer of 0 to 10, and a hydroxylbenzoic acid derivative of the above formula (III) excluding salicylamide and a derivative thereof.

The diphenylsulfone derivative of the above formula (IV) is disclosed in JP-A-10-862 and JP-A-10-29969.

In the above formula (IV), specific examples of the group which Q an Y stand for include methylene, ethylene, trimethylene, tetramethylene, pentamethylene, hexamethylene, heptamethylene, octamethylene, nonamethylene, decamethylene, undecamethylene, dodecamethylene, methylmethylene, dimethylmethylene, methylethylene, ethylethylene, 1,2-dimethylethylene, 1-methyltrimethylene, 1-methyltetramethylene, 1,3-dimethyltrimethylene, 1-ethyl-4-methyl-tetramethylene, vinylene, propenylene, 2-butenylene, ethylenylene, 2-butynylene, 1-vinylethylene, ethyleneoxyethylene, tetramethyleneoxytetramethylene, ethyleneoxyethylene-oxyethylene, ethyleneoxymethyleneoxyethylene, 1,3-dioxane-5,5-bismethylene, 1,2-xylilene, 1,3-xylilene, 1,4-xylilene, 2-hydroxytrimethylene, 2-hydroxy-2-methyltrimethylene, 2-hydroxy-2-ethyltrimethylene, 2-hydroxy-2-propyltrimethylene, 2-hydroxy-2-isorpopyltrimethylene and 2-hydroxy-2-butyltrimethylene groups.

The alkyl or alkenyl represented by $R^7$ to $R^{12}$ is preferably a $C_1$–$C_6$ alkyl group or a $C_2$–$C_4$ alkenyl group, and specific examples thereof include methyl, ethyl, n-propyl, isopropyl, n-butyl, sec-butyl, tert-butyl, n-pentyl, isopentyl, neopentyl, tert-pentyl, n-hexyl, isohexyl, 1-methylpentyl, 2-methylpentyl, vinyl, allyl, isopropenyl, 1-propenyl, 2-butenyl, 3-butenyl, 1,3-butanedienyl and 2-methyl-2-propenyl. The halogen represented by $R^7$ to $R^{12}$ includes chlorine, bromine, fluorine and iodine atoms.

The diphenylsulfone derivative of the formula (IV) in which w is 0 includes those described in JP-A-7-149713, and typical examples thereof are as follows.

(1-1) 1,1-bis[4-(4-hydroxyphenylsulfonyl)phenoxy] methane, (1-2) 1,2-bis[4-(4-hydroxyphenylsulfonyl)phenoxy]ethane, (1-3) 1,3-bis[4-(4-hydroxyphenylsulfonyl)phenoxy] propane, (1-4) 1,4-bis[4-(4-hydroxyphenylsulfonyl)phenoxy]butane, (1-5) 1,5-bis[4-(4-hydroxyphenylsulfonyl)phenoxy] pentane, (1-6) 1,6-bis[4-(4-hydroxyphenylsulfonyl)phenoxy]hexane, (1-7) α,α'-bis[4-(4-hydroxyphenylsulfonyl)phenoxy]-o-xylene, (1-8) α,α'-bis[4-(4-hydroxyphenylsulfonyl)phenoxy]-m-xylene, (1-9) α,α'-bis[4-(4-hydroxyphenylsulfonyl)phenoxy]-p-xylene, (1-10) 1,3-bis[4-(4-hydroxyphenylsulfonyl)phenoxy]-2-hydroxypropane, (1-11) 2,2'-bis[4-(4-hydroxyphenylsulfonyl)phenoxy] diethyl ether, (1-12) 4,4'-bis[4-(4-hydroxyphenylsulfonyl)phenoxy] dibutyl ether, (1-13) 1,2-bis[4-(4-hydroxyphenylsulfonyl)phenoxy] ethylene, and (1-14) 1,4-bis[4-(4-hydroxyphenylsulfonyl)phenoxy]-2-butene.

Specific examples of the diphenylsulfone derivative of the formula (IV) in which w is other than 0 include:

(2-1) 4,4'-bis[4-{4-(4-hydroxyphenylsulfonyl)phenoxy}-2-trans-butenyloxy]diphenylsulfone, (2-2) 4,4'-bis[4-{4-(4-hydroxyphenylsulfonyl)phenoxy}-butyloxy]diphenylsulfone, (2-3) 4,4'-bis[3-{4-(4-hydroxyphenylsulfonyl)phenoxy}-propyloxy]diphenylsulfone, (2-4) 4,4'-bis[2-{4-(4-hydroxyphenylsulfonyl)phenoxy}-diethyloxy]diphenylsulfone, (2-5) 4-[4-{4-(4-hydroxyphenylsulfonyl)phenoxy}bultyl-oxy]-4'-[3-{4-(4-hydroxyphenylsulfonyl) phenoxy}propyloxy]-diphenylsulfone, (2-6) 4-[4-{4-(4-hydroxyphenylsulfonyl)phenoxy}butyl-oxy]-4'-[2-{4-(4-hydroxyphenylsulfonyl)phenoxy}ethyl-oxyl]-diphenylsulfone, (2-7) 4-[3-{4-(4-hydroxyphenyisulfonyl)phenoxy}propyl-oxy]-4'-[2-{4-(4-hydroxyphenylsulfonyl)phenoxy}ethyl-oxy]-diphenylsulfone, (2-8) 4,4'-bis[5-{4-(4-hydroxyphenylsulfonyl)phenoxy}-pentyloxy]diphenylsulfone, (2-9) 4,4'-bis[6-{4-(4-hydroxyphenylsulfonyl)phenoxy}-hexyloxy]diphenylsulfone, (2-10) 4-[4-{4-(4-hydroxyphenylsulfonyl)phenoxy}-2-trans-butenyloxy]-4'-[4-{4-(4-hydroxyphenylsulfonyl) phenoxy}-butyloxy]diphenysulfone, (2-11) 4-[4-{4-(4-hydroxyphenylsulfonyl)phenoxy}-2-trans-butenyloxy]-4'-[3-{4-(4-hydroxyphenylsulfonyl) phenoxy}-propyloxy]diphenylsulfone, (2-12) 4-[4-{4-(4-hydroxyphenylsulfonyl)phenoxy}-2-trans-butenyloxy]-4'-[2-{4-(4-hydroxyphenylsulfonyl) phenoxy}-ethyloxy]diphenylsulfone, (2-13) 1,4-bis[4-[4-[4-{4-(4-hydroxyphenylsulfonyl) phenoxy}-2-trans-butenyloxy]phenylsulfonyl]phenoxy]-cis-2-butene, (2-14) 1,4-bis[4-[4-[4-{4-(4-hydroxyphenylsulfonyl) phenoxy}-2-trans-butenyloxy]phenylsulfonyl]phenoxy]-trans-2-butene, (2-15) 4,4'-bis[4-{4-(2-hydroxyphenylsulfonyl)phenoxy}-butyloxy]diphenylsulfone, (2-16) 4,4'-bis[4-{2-(4-hydroxyphenylsulfonyl)phenoxy}-butyloxy]diphenylsulfone, (2-17) 4,4'-bis[2-[2-{4-(4-hydroxyphenylsulfonyl) phenoxy}-ethyleneoxy]ethoxy]diphenylsulfone, (2-18) 4,4'-bis{4-(4-hydroxyphenylsulfonyl)phenyl-1,4-phenylenebismethyleneoxy}diphenylsulfone, (2-19) 4,4'-bis{4-(4-hydroxyphenylsulfonyl)phenyl-1,3-phenylenebismethyleneoxy}diphenylsulfone, (2-20) 4,4'-bis{4-(4-hydroxyphenylsulfonyl)phenyl-1,2-phenylenebismethyleneoxy}diphenylsulfone, (2-21) 2,2'-bis[4-[4-[2-[2-{4-(4-hydroxyphenylsulfonyl) phenoxy}ethyleneoxy]ethoxy]phenylsulfonyl]phenoxy] diethyl ether, (2-22) α,α'-bis[4-[4-[-4-{(4-hydroxyphenylsulfonyl) phenyl}-1,4-phenylenebismethyleneoxyphenylsulfonyl] phenoxy]-p-xylene, (2-23) α,α'-bis[4-[4-{4-(4-hydroxyphenylsulfonyl)phenyl}-1,3-phenylenebismethyleneoxyphenylsulfonyl]phenoxy]-m-xylene, (2-24) α,α'-bis[4-[4-{4-(4-hydroxyphenylsulfonyl)phenyl}-1,2-phenylenebismethyleneoxyphenylsulfonyl]phenoxy]-o-xylene, (2-25) 2,4'-bis[2-[2-{2-(4-hydroxyphenylsulfonyl)phenoxy}-ethyleneoxy]ethoxy]diphenylsulfone, (2-26) 2,4'-bis[2-[2-{4-(2-hydroxyphenylsulfonyl)phenoxy}-ethyleneoxy]ethoxy]diphenylsulfone, (2-27) 4,4'-bis[2-[2-{3,5-dimethyl-4-(3,5-dimethyl-4-hydroxyphenylsulfonyl)phenoxy}ethyleneoxy]ethoxy]-diphenysulfone, (2-28) 4,4'-bis[2-[2-{3-allyl-4-(3-allyl-4-hydroxyphenylsulfonyl)phenoxy}ethyleneoxy]ethoxy]-diphenylsulfone, (2-29) 4,4'-bis[2-[2-{3,5-dimethyl-4-(3,5-dimethyl-4-hydroxyphenylsulfonyl)phenyl-1,4-phenylenebismethyleneoxy}diphenysulfone, (2-30) 4,4'-bis(3,5-dimethyl-4-(3,5-dimethyl-4-hydroxyphenylsulfonyl)phenyl-1,3-phenylenebismethyleneoxy]diphenylsulfone, (2-31) 4,4'-bis[3,5-dimethyl-4-(3,5-dimethyl-4-hydroxyphenylsulfonyl)phenyl-1,2-phenylenebismethyleneoxy]diphenylsulfone, (2-32) 4,4'-bis[3-allyl-4-(3-allyl-4-ydroxyphenylsulfonyl)-1,4-phenylenebismethyleneoxy]diphenylsulfone, (2-33) 4,4'-bis[3-allyl-4-(3-allyl-4-ydroxyphenylsulfonyl)-1,3-phenylenebismethyleneoxy]diphenylsulfone, (2-34) 4,4'-bis[3-allyl-4-(3-allyl-4-ydroxyphenylsulfonyl)-1,2-phenylenebismethyleneoxy]diphenylsulfone, (2-35) 4,4'-bis[4-(4-ydroxyphenylsulfonyl)phenoxy-2-hydroxypropyloxy]diphenylsulfone, and (2-36) 1,3-bis[4-[4-{4-(4-ydroxyphenylsulfonyl)phenoxy-2-hydroxypropyloxy]phenylsulfonyl]phenoxy]-2-hydroxypropane.

In the heat-sensitive recording material II of the present invention, at least one diphenylsulfone derivative of the formula (IV) in which w is 0, at least one diphenylsulfone derivative of the formula (IV) in which w is 1 to 10, or a combination of at least one diphenylsulfone derivative of the formula (IV) in which w is 0 and at least one diphenylsulfone derivative of the formula (IV) in which w is 1 to 10 may be used in the heat-sensitive recording layer.

Due to synergistic effects of the diphenylsulfone derivative of the formula (IV) and the hydroxybenzoic acid derivative of the formula (III) excluding salicylamide and the derivative thereof, the heat-sensitive recording material II of the present invention exhibits high thermal response and has excellent retainability of a recorded image against heat and humidity and further against chemicals such as a plasticizer.

Specific examples of the above hydroxybenzoic acid derivative include ethyl 4-hydroxybenzoate, propyl 4-hydroxybenzoate, butyl 4-hydroxybenzoate and benzyl 4-hydroxybenzoate. These compounds may be used alone or in combination. Of these, benzyl 4-hydroxybenzoate is particularly preferred.

In the heat-sensitive recording material II of the present invention, the weight ratio of the above diphenylsulfone derivative/the above hydroxybenzoic acid derivative is preferably 0.5/6.5 to 5/2, more preferably 2/5 to 1/1. When the content of the diphenylsulfone derivative is too large, that is, when the content of the hydroxybenzoic acid derivative is too small, it is difficult to achieve excellent thermal response. Further, when each of the above contents is the reverse, it is difficult to achieve sufficient stability of a recorded image, and, particularly, the retainability of an image against chemicals such as a plasticizer decreases to a large extent.

In this case, the heat-sensitive recording layer preferably contains a phosphate ester of the formula (V), (V)

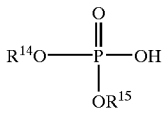

wherein each of $R^{14}$ and $R^{15}$ is independently alkyl, alkenyl, aralkyl or aryl, and they may bond to each other to form a ring structure, or a salt thereof, as an additive. The above phosphate ester works to achieve further superior thermal response. The reason therefor is assumed to be that the phosphate ester or a salt thereof present in the vicinity of the electron-accepting compound improves the compatibility of the dye precursor and the electron-accepting compound.

Further, it is assumed that because of the improvement in the compatibility of the dye precursor and the electron-accepting compound, a recorded image is stabilized even in an environment under heat and humidity and that the retainability of a recorded image is accordingly improved.

Further, the phosphate ester of the formula (V) or a salt thereof can serve to prevent a whitening phenomenon called "powdering" which is caused by a fine crystal formed on the surface of a recorded image portion. It is also assumed that the above is achieved since a recorded image is stabilized due to the improvement in the compatibility of the dye precursor and the electron-accepting compound.

Specific examples of the phosphate ester of the formula (V) or salts thereof include diphenylhydrogen phosphate, bis(4-tert-butylphenyl)hydrogen phosphate, bis(4,6-di-tert-butylphenyl)hydrogen phosphate, bis(4-chlorophenyl) hydrogen phosphate, bis(benzyloxyphenyl)hydrogen phosphate, 2,2'-methylenebis(4,6-di-tert-butylphenyl) hydrogen phosphate, dimethylhydrogen phosphate, diethylhydrogen phosphate, bis(3,5-di-tert-butyl-4-hydroxyphenyl) hydrogen phosphate and slats of these. The salts include alkali metal salts, alkaline earth metal salts, transition metal salts and amine salts. The above phosphate esters or salts thereof may be used alone or in combination.

Of the above phosphate esters or salts thereof, 2,2'-methylenebis(4,6-di-tert-butylphenyl)hydrogen phosphate or a salt thereof is preferred.

The content of the phosphate ester of the formula (V) or the salt thereof based on the electron-accepting compound is preferably 3 to 50% by weight, more preferably 5 to 30% by weight.

When the content of the phosphate ester of the formula (V) or the salt thereof is less than 3% by weight based on the electron-accepting compound, there is produced almost no effect on improvements of thermal response and retainability of a recorded image. When the above content exceeds 50% by weight, the contact of the electron-donating dye precursor and the electron-accepting compound comes to be inhibited, and the thermal response is caused to decrease.

Further, the heat-sensitive recording layer preferably contains, as an additive, a salicylamide of the formula (VI), (VI)

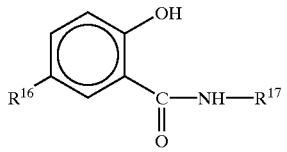

wherein $R^{16}$ is hydrogen, halogen, alkyl, alkenyl, aralkyl or aryl, $R^{17}$ is hydrogen, alkyl, alkenyl, aralkyl, aryl, halogenoalkyl, halogenoaryl, alkoxyaryl or alkylthioaryl, or a derivative thereof. The above salicylamide or a salt thereof can serve to achieve further superior thermal response.

Specific examples of the above salicylamide or derivatives thereof include salicylamide, salicylanilide, salicyl-o-chloroanilide, salicyl-p-chloroanilide, salicyl-o-methylanilide, salicyl-p-methylanilide, salicyl-p-ethylanilide, salicyl-p-isobutylanilide, salicyl-m-trifluoroanilide, salicyl-p-butylanilide, 5-chlorosalicylanilide, 5-methylsalicylanilide, 5-benzylsalicylanilide, 5-cumylsalicylanilide, 5-tert-butylsalicylanidlie, 5-tert-butylsalicyl-p-methoxyanilide, 5-tert-butylsalicyl-m-methylthioanilide, 5-tert-butylsalicyl-2',3'-dimethylanilide, 5-phenylsalicylanilide, 5-naphthylsalicylanilide, 5-benzylaminosalicylanilide and 5-methylaminosalicylanilide, although the salicylamide or the derivatives thereof shall not be limited to these. The above salicylamides or the derivatives thereof may be used alone or in combination.

The content of the salicylamide of the formula (VI) or the derivative thereof based on the electron-accepting compound is preferably 3 to 200% by weight, more preferably 5 to 50% by weight.

When the content of the salicyclamide of the formula (VI) or the derivative thereof is less than 3% by weight based on the electron-accepting compound, there is produced almost no effect on the improvement of thermal response. When the above content exceeds 200% by weight, the resistance to ground fogging under heat is degraded to a large extent.

In the thermal-sensitive recording material II of the present invention, other electron-accepting compound can be used as required in combination with the above various diphenylsulfone derivatives and hydroxybenzoic acid derivatives so long as the effects of the present invention are not impaired. The above "other" electron-accepting compound can be selected from those specified in the explanation of the heat-sensitive recording material I.

In the heat-sensitive recording material II of the present invention, the heat-sensitive recording layer may contain a heat-meltable substance as required for improving the thermal response thereof. The heat-meltable substance preferably has a melting point of 60 to 180° C., more preferably 80 to 140° C. The above heat-meltable substance can be selected from those specified in the explanation of the heat-sensitive recording material I.

The heat-sensitive recording material III of the present invention will be explained hereinafter.

In the heat-sensitive recording material III, the heat-sensitive recording layer contains a diphenylsulfone derivative as an electron-accepting compound and a diphenyl ether derivative which is a sensitizer as an additive.

The above diphenylsulfone derivative can be selected from compounds of the already described formula (I). Specific examples of the compounds of the formula (I) are as already described in the explanation of the heat-sensitive recording material I. Those diphenylsulfone derivatives may be used alone or in combination.

The above diphenyl ether derivative can be selected from compounds of the formula (VII), (VII)

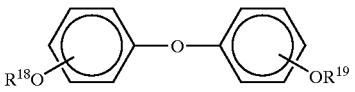

wherein each of $R^{18}$ and $R^{19}$ is independently alkyl, alkenyl or alkylcarbonyl.

Specific examples of the diphenyl ether derivatives of the formula (VII) in which each of $R^{18}$ and $R^{19}$ is lower alkyl include bis(4-methoxyphenyl)ether, bis(4-ethoxyphenyl)ether, bis(4-isopropoxyphenyl)ether, bis(4-butoxyphenyl)ether. Specific examples of the diphenyl ether derivatives of the formula (VII) in which each of $R^{18}$ and $R^{19}$ is alkenyl include bis(4-acryloxyphenyl)ether and bis[4-(2-methylpropyl-2-ene)oxyphenyl]ether. Specific examples of the diphenyl ether derivatives of the formula (VII) in which each of $R^{18}$ and $R^{19}$ is lower alkylcarbonyl include bis(4-acetoxyphenyl)ether and bis(4-ethylcarbonyloxyphenyl)ether. The diphenyl ether derivative shall not be limited to these. The above diphenyl ether derivatives may be used alone or in combination.

In the heat-sensitive recording material III of the present invention, the electron-accepting compound which reacts with the dye precursor under heat to cause the dye precursor to form a color is selected from the diphenylsulfone derivatives of the formula (I), and the sensitizer is selected from diphenyl ether derivatives of the formula (VII), whereby the heat-sensitive recording material III has excellent color-forming sensitivity and excellent stabilized retainability of an image portion.

Further, when the diphenyl ether derivatives described formula (VII) is selected from compounds of the formula (VIII), (VIII)

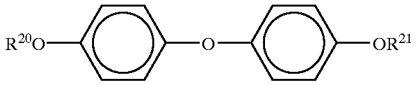

wherein each of $R^{20}$ and $R^{21}$ is independently lower alkyl, lower alkenyl or lower alkylcarbonyl, the heat-sensitive recording material III particularly has excellent color-forming sensitivity and excellent stabilized retainability of an image portion.

Further, when 4,4'-dimethoxydiphenyl ether is used as a diphenyl ether derivative, and when the diphenylsulfone derivative is selected from compounds of the formula (IX), (IX)

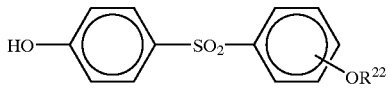

wherein $R^{22}$ is hydrogen, alkyl or aralkyl, the heat-sensitive recording material III has further excellent color-forming sensitivity and excellent stabilized retainability of an image portion.

The content of the diphenyl ether derivative of the formula (VII) based on the diphenylsulfone derivative of the formula (I) is preferably 10 to 400% by weight, more preferably 20 to 300% by weight. When the above content is less than 10% by weight, the effect of improving the sensitivity is insufficient. When the above content exceeds 400% by weight, the amount of the heat-meltable substance is too large and as a result, a dilution effect appears so that the color density decreases. Moreover, such a large content is costwise disadvantageous.

In the thermal-sensitive recording material III of the present invention, other electron-accepting compound can be used as required in combination with the above various diphenylsulfone derivatives so long as the effects of the present invention are not impaired. The above "other" electron-accepting compound can be selected from those specified in the explanation of the heat-sensitive recording material I.

In the heat-sensitive recording material III of the present invention, further, the heat-sensitive recording layer may contain a heat-meltable substance as required for improving the thermal response thereof. The heat-meltable substance preferably has a melting point of 60 to 180° C., more preferably 80 to 140° C. The above heat-meltable substance can be selected from those specified in the explanation of the heat-sensitive recording material I.

The heat-sensitive recording material IV of the present invention will be explained hereinafter.

In the heat-sensitive recording material IV, the heat-sensitive recording layer contains a diphenylsulfone derivative as an electron-accepting compound and further contains salicylamide or a derivative thereof as an additive.

The above diphenylsulfone derivative can be selected from compounds of the already described formula (I). Specific examples of the compounds of the formula (I) are as already described in the explanation of the heat-sensitive recording material I. Those diphenylsulfone derivatives may be used alone or in combination.

Of the above diphenylsulfone derivatives, a diphenylsulfone derivative having a melting point of at least 130° C. is preferred, and a diphenylsulfone derivative having a melting point of at least 150° C. is more preferred, for achieving high retainability of a recorded image against heat, although it differs depending upon combinations with the dye precursor. Of the diphenylsulfone derivatives, 4,4'-dihydroxydiphenylsulfone is preferred since it has a melting point of over 200° C. so that the color formation of a ground portion under a heater device is controlled to the lowest level.

The content of the diphenylsulfone derivative per part by weight of the dye precursor is preferably 0.2 to 5.0 parts by weight. When the above content is less than 0.2 part by weight, it is difficult to achieve sufficient recording density. When it is greater than 5.0 parts by weight, it may be difficult to achieve sufficient retainability of recorded images against high temperatures.

The salicylamide or its derivative used as an additive can be selected from compounds of the already described formula (VI). Specific examples of the above salicylamide or the derivative thereof are as already described in the explanation of the heat-sensitive recording material II. Those silicyalamides or the derivatives thereof may be used alone or in combination.

The salicylamide or the derivative thereof improves a recording sensitivity to a greater extent with an increase in its content, while it has a defect that the retainability of a recorded image against high temperatures decreases when the content thereof is large. It is therefore required to control the content thereof. The optimum amount thereof differs depending upon kinds of the diphenylsulfone derivative, the salicylamide or its derivative and the dye precursor, while it is preferred to generally use less than 1 part by weight of the salicylamide or the derivative thereof based on 1 part by weight of the dye precursor. In this case, the recording sensitivity can be improved without impairing the retainability of a recorded image against high temperatures.

In the heat-sensitive recording material IV of the present invention, of the above dye precursors, a dye precursor having a melting point of 180° C. or higher is preferred since the density of a formed color in a ground portion is low when a heat-sensitive recording material is brought into contact with a heater device having a high temperature.

As the above dye precursor, it is particularly preferred to use any one of 3-dibutylamino-7-(o-chloroanilino)fluoran, 3-diethylamino-7-(m-trifluoromethylanilino)fluoran, 3-(N-ethyl-N-p-tolyl)amino-6-methyl-7-anilinofluoran, and 3-di-n-butylamino-6-methyl-7-anilinofluoran.

In the thermal-sensitive recording material IV of the present invention, other electron-accepting compound can be used as required in combination with the above various diphenylsulfone derivatives so long as the effects of the present invention are not impaired. The above "other" electron-accepting compound can be selected from those specified in the explanation of the heat-sensitive recording material I.

In the heat-sensitive recording material IV of the present invention, further, the heat-sensitive recording layer may contain a heat-meltable substance as required for improving the thermal response thereof. The heat-meltable substance preferably has a melting point of 60 to 180° C., more preferably 80 to 140° C. The above heat-meltable substance can be selected from those specified in the explanation of the heat-sensitive recording material I.

The heat-sensitive recording material V of the present invention will be explained hereinafter.

In the heat-sensitive recording material V, the heat-sensitive recording layer contains 4,4'-dihydroxydiphenylsulfone as an electron-accepting compound and further contains salicylanilide and dibenzyloxalate, which are sensitizers, as an additive.

The above 4,4'-dihydroxydiphenylsulfone used as an electron-accepting compound in the heat-sensitive recording material V is disclosed in JP-A-57-11088, and it is a heat-meltable substance having a melting point of 235 to 250° C. Concerning the use thereof as a color developing substance, JP-A-57-169393, JP-A-58-126189 and JP-A-61-160292 disclose the use thereof in combination with other color developing substance.

Salicylanilide for use as a sensitizer has a melting point of approximately 135° C., and dibenzyloxalate for use as a sensitizer has a melting point of approximately 80° C. Both of these compounds have been known as a sensitizer, while nothing has been known with regard to excellent effects produced by the use of these in combination with 4,4'-dihydroxydiphenylsulfone like the present invention.

In the heat-sensitive recording layer of the heat-sensitive recording material V of the present invention, the content of the above sensitizer (salicylanilide and dibenzyloxalate) based on the 4,4'-dihydroxysulfone is generally 50 to 300% by weight, preferably 75 to 250% by weight. When the above content is less than 50% by weight, it is difficult to obtain a sensitizing effect thereof, and when it exceeds 300% by weight, no further improvement in the sensitizing effect is produced, and with an increase in the amount of a heat-melting substance including the sensitizer and the color-developing substance, the amount of the heat-melted substance adhering to a heating head increases (adhering scums), so that printing may be impaired.

In the present invention, it is preferred to incorporate an aliphatic acid amide into the heat-sensitive recording layer. In this case, there can be obtained a heat-sensitive recording material having a far higher sensitivity and an excellent color-formability in printing.

The above aliphatic acid amide can be selected from commercially available aliphatic acid amides such as lauric acid amide, myristic acid amide, palmitic acid amide, stearic acid amide, behenic acid amide, erucic acid amide, N,N'-ethylenebislauric acid amide, N,N'-methylenebisstearic acid amide, N,N'-ethylenebisstearic acid amide, N,N'-ethylenebisoleic acid amide, N,N'-ethylenebisbehenic acid amide, methylol stearate amide, N,N'-distearylstearic acid amide, and N,N'-dioleyladipic acid amide, although the aliphatic amide shall not be limited thereto.

It is proper to use an aliphatic acid amide having a melting point of at least 80° C., and of the above aliphatic acid amides, stearic acid amide, N,N'-ethylenebisstearic acid amide and palmitic acid amide are particularly preferred.

The above aliphatic acid amides may be used alone or in combination. The amount of the aliphatic acid amide based on the 4,4'-dihydroxydiphenylsulfone is generally 5 to 150% by weight, preferably 10 to 75% by weight. When the above amount is less than 5% by weight, almost no effect of improving the color-formability can be obtained. When it exceeds 150% by weight, there is produced almost no further effect.

In the heat-sensitive recording material V of the present invention, it is preferred to form at least one overcoating layer on the heat-sensitive recording layer. The overcoating layer serves to improve the retainability of a recorded image. The method of forming the overcoating layer will be explained later.

In the heat-sensitive recording material V of the present invention, other electron-accepting compound can be used as required in combination with the 4,4'-dihydroxydiphenylsulfone so long as the effects of the present invention are not impaired. The above "other" electron-accepting compound can be selected from those specified in the explanation of the heat-sensitive recording material I.

In the heat-sensitive recording materials I to V of the present invention, the heat-sensitive recording layer can be formed by mixing an aqueous dispersion obtained by finely milling color-forming components, a binder and the like, applying the dispersion on a substrate and drying a coating. The heat-sensitive recording layer may have a mono-layered structure or a multi-layered structure.

The above binder can be selected from those binders that are used for general applications. Specific examples of the binder include water-soluble binders such as starches, hydroxymethyl cellulose, methyl cellulose, ethyl cellulose, carboxymethyl cellulose, gelatin, casein, polyvinyl alcohol, denatured polyvinyl alcohol, sodium alginate, polyvinyl pyrrolidone, polyacrylamide, an acrylamide/acrylate copolymer, an acrylamide/acrylate/methacrylate terpolymer, an alkali salt of polyacrylic acid, an alkali salt of polymaleic acid, an alkali salt of a styrene/maleic acid anhydride copolymer, an alkali salt of an ethylene/maleic acid anhydride copolymer and an alkali salt of isobutylene/maleic acid anhydride copolymer, and water-dispersible binders such as a styrene/butadiene copolymer, an acrylonitrile/butadiene copolymer, a methyl acrylate/butadiene copolymer, an acrylonitrile/butadiene/styrene terpolymer, polyvinyl acetate, a vinyl acetate/acrylate copolymer, an ethylene/vinyl acetate copolymer, polyacrylate, a styrene/acrylate copolymer and polyurethane, although the binder shall not be limited thereto.

The heat-sensitive recording layer may contain a pigment. The pigment includes inorganic pigments such as diatomaceous earth, talc, kaolin, calcined kaolin, calcium bicarbonate, precipitated calcium carbonate, magnesium carbonate, zinc oxide, aluminum oxide, aluminum hydroxide, magnesium hydroxide, titanium dioxide, barium sulfate, zinc sulfate, amorphous silica, amorphous calcium silicate and colloidal silica and organic pigments such as a melamine resin filler, a urea-formalin resin filler, a polyethylene powder and a nylon powder.

Further, the heat-sensitive recording layer may contain a head wearing preventer, a sticking preventer, a light resistance improver, a dispersing agent, a wetting agent, a fluorescence dye and an anti-foamer as required. The head wearing and sticking preventer include a higher fatty acid metal salt such as zinc stearate and calcium stearate, higher fatty acid amides such as stearic acid amide, and lubricants such as paraffin, polyethylene wax, polyethylene oxide and castor wax. The light resistance improver includes benzophenone or benzotriazole ultraviolet ray absorbers.

The dispersing wetting agent includes nonionic and anionic surfactants including surfactants having high molecular weights.

The method of forming the heat-sensitive recording layer is not specially limited, and the heat-sensitive recording layer can be formed by a conventional method. Specifically, a coating solution is applied to a substrate by any one of conventional methods such as air knife coating, rod blade coating, bar coating, blade coating, gravure coating, curtain coating and E bar coating methods and a coating is dried, whereby the heat-sensitive recording layer can be formed.

Generally, the coating amount of the heat-sensitive recording layer is properly 0.1 to 2.0 g/m$^2$ as a coating amount of the dye precursor. When the above coating amount is smaller than 0.1 g/m$^2$, no sufficient recording density can be obtained. When it exceeds 2.0 g/m$^2$, no further improvement is found in color-forming sensitivity, and such a large amount is disadvantageous in cost performance.

In the heat-sensitive recording material of the present invention, at least one single or multi-layered undercoating layer of a pigment or a resin may be formed between the substrate and the heat-sensitive recording layer. When the heat-sensitive recording material of the present invention has an undercoating layer, the coating amount of the undercoating layer is preferably 1 to 30 g/m$^2$, more preferably 3 to 20 g/m$^2$.

As a pigment for the undercoating layer, kaolin is generally used, while the pigment can be also selected from inorganic pigments such as diatomaceous earth, talc, kaolin, calcium bicarbonate, precipitated calcium carbonate, magnesium carbonate, zinc oxide, aluminum oxide, aluminum hydroxide, magnesium hydroxide, titanium dioxide, barium sulfate, zinc sulfate, amorphous silica, amorphous calcium silicate and colloidal silica, organic pigments such as a melamine resin filler, a urea-formalin resin filler, a polyethylene powder and a nylon powder, and organic hollow pigment.

The resin for the undercoating layer can be selected from various water-soluble and water-dispersible resins used for general coatings. Examples of the above resin include water-soluble resins such as starches, hydroxymethyl cellulose, methyl cellulose, ethyl cellulose, carboxymethyl cellulose, gelatin, casein, polyvinyl alcohol, denatured polyvinyl alcohol, sodium alginate, polyvinyl pyrrolidone, polyacrylamide, an acrylamide/acrylate copolymer, an acrylamide/acrylate/methacrylic acid terpolymer, an alkali salt of polyacrylic acid, an alkali salt of polymaleic acid, an alkali salt of a styrene/maleic acid anhydride copolymer, an alkali salt of an ethylene/maleic acid anhydride copolymer and an alkali salt of isobutylene/maleic acid anhydride copolymer, and water-dispersible resins such as a styrene/butadiene copolymer, an acrylonitrile/butadiene copolymer, a methyl acrylate/butadiene copolymer, an acrylonitrile/butadiene/styrene terpolymer, polyvinyl acetate, a vinyl acetate/acrylate copolymer, an ethylene/vinyl acetate copolymer, polyacrylate, a present invention, the retainability of a recorded image can be improved by forming at least one protective layer (overcoatlng layer) composed mainly of a water-soluble resin or a water-dispersible resin on a formed heat-sensitive recording layer. Further, there may be used a resin which forms a coating under irradiation with electron beams or ultraviolet light. The protective layer as a dry coating preferably has a coating weight of 0.2 to 10 g/m$^2$, more preferably 1 to 5 g/m$^2$.

In the present invention, the water-soluble resin or the water-dispersible resin is selected from known water-soluble or water-dispersible resins. That is, the water-soluble resin can be selected, for example, from polyvinyl alcohol, denatured polyvinyl alcohol, starch or its derivative, cellulose derivartives such as hydroxyethyl cellulose, methyl cellulose, ethyl cellulose and carboxymethyl cellulose, polyvinyl pyrrolidone, polyacrylamide, an acrylamide/acrylate copolymer, an acrylamide/acrylate/methacrylic acid terpolymer, an alkaline salt of polyacrylic acid, an alkaline salt of polymaleic acid, an alkaline salt of a styrene/maleic acid anhydride copolymer, an alkaline salt of an ethylene/maleic acid anhydride copolymer, an alkaline salt of isobutylene/maleic acid anhydride copolymer, sodium alginate, gelatin, casein and an acid neutralization product of chitosan.

The water-dispersible resin can be selected, for example, from a styrene/butadiene copolymer, an acrylonitrile/butadiene copolymer, a methyl acrylate/butadiene copolymer, an acrylonitrile/butadiene/styrene terpolymer, polyvinyl acetate, a vinyl acetate/acrylate copolymer, an ethylene/vinyl acetate copolymer, polyacrylate, a styrene/acrylate copolymer and polyurethane.

The protective layer may contain a pigment for improving the heat-sensitive recording material in running properties and recording/printing properties. Specific improving the heat-sensitive recording material in running properties and recording/printing properties. Specific examples of the above pigment include inorganic pigments such as diatomaceous earth, talc, kaolin, calcined kaolin, calcium bicarbonate, precipitated calcium carbonate, magnesium carbonate, zinc oxide, aluminum oxide, aluminum hydroxide, magnesium hydroxide, titanium dioxide, barium sulfate, zinc sulfate, amorphous silica, amorphous calcium silicate and colloidal silica, and organic pigments such as a melamine resin filler, a urea-formalin resin filler, a polyethylene powder and a nylon powder.

For preventing the wearing and sticking of a head for improving running properties, further, the protective layer contains a higher fatty acid metal salt such as zinc stearate or calcium stearate, a fatty acid amide such as stearic acid amide or a lubricant such as paraffin, polyethylene wax, polyethylene oxide or castor wax.

The method of forming each of the undercoating layer and the overcoating layer is not specially limited, and the undercoating layer and the overcoating layer can be formed by any one of conventional methods. Specifically, the undercoating layer and the overcoating layer can be formed by applying a coating solution according to a method such as air knife coating, rod blade coating, bar coating, blade coating, gravure coating, curtain coating or E bar coating method and drying a coating.

Further, if necessary, after undercoating, the formed undercoating layer, the formed heat-sensitive recording layer or the formed protective layer may be treated by super calendaring for improving an image quality.

The heat-sensitive recording material of the present invention, produced as described above, has the heat-sensitive recording layer containing the electron-donating dye precursor and the electron-accepting compound which causes the dye precursor to form a color, and has characteristic features that it has high color-forming sensitivity (excellent thermal response) and a high color

EXAMPLES

The present invention will be explained more in detail with reference to Examples hereinafter, while the present invention shall not be limited thereto. In Examples, "part" stands for "part by weight" and "%" stands for "% by weight". Further, any coating amount of any layer refers to an absolute dry coating amount.

Preparation Example 1

Preparation of Dispersions A–H

<Dispersion A>

200 Grams of 3-di-n-butylamino-6-methyl-7-anilinofluoran was dispersed in a mixture of 200 g of a 10% polyvinyl alcohol aqueous solution with 600 g of water and milled with a bead mill until it had an average particle diameter of 1 $\mu$m.

<Dispersion B>

200 Grams of 4-hydroxy-4'-isopropxydiphenylsulfone was dispersed in a mixture of 200 g of a 10% polyvinyl alcohol aqueous solution with 600 g of water and milled with a bead mill until it had an average particle diameter of 1 $\mu$m.

<Dispersion C>

200 Grams of 4-hydroxy-4'-n-propoxydiphenylsulfone was dispersed in a mixture of 200 g of a 10% polyvinyl alcohol aqueous solution with 600 g of water and milled with a bead mill until it had an average particle diameter of 1 $\mu$m.

<Dispersion D>

200 Grams of 4-hydroxy-4'-benzyloxydiphenylsulfone was dispersed in a mixture of 200 g of a 10% polyvinyl alcohol aqueous solution with 600 g of water and milled with a bead mill until it had an average particle diameter of 1 $\mu$m.

<Dispersion E>

200 Grams of 2,2-bis(p-hydroxyphenyl)propane was dispersed in a mixture of 200 g of a 10% polyvinyl alcohol aqueous solution with 600 g of water and milled with a bead mill until it had an average particle diameter of 1 $\mu$m.

<Dispersion F>

200 Grams of benzyl 4-hydroxybenzoate was dispersed in a mixture of 200 g of a 10% polyvinyl alcohol aqueous solution with 600 g of water and milled with a bead mill until it had an average particle diameter of 1 $\mu$m.

<Dispersion G>

200 Grams of benzyl-2-naphthyl ether was dispersed in a mixture of 200 g of a 10% polyvinyl alcohol aqueous solution with 600 g of water and milled with a bead mill until it had an average particle diameter of 1 $\mu$m.

<Dispersion H>

200 Grams of aluminum hydroxide was dispersed in 800 g of a 0.5% sodium polyacrylate aqueous solution and stirred with a homomixer for 10 minutes.

Example 1

The dispersions A, B, C, G and H obtained in Preparation Example 1 and the following other components were mixed in the following mixing ratio, and the mixture was fully stirred to obtain a coating solution for a heat-sensitive recording layer.

| | |
|---|---|
| Dispersion A | 5 parts |
| Dispersion B | 5 parts |
| Dispersion C | 5 parts |
| Dispersion G | 15 parts |
| 40% zinc stearate dispersion | 2.5 parts |
| Dispersion H | 15 parts |
| 10% polyvinyl alcohol aqueous solution | 35 parts |
| Water | 10 parts |

The above-prepared coating solution for a heat-sensitive recording layer was coated on a substrate paper having a basis weight of 40 g/m$^2$ with a wire bar so as to form a coating having a dry coating weight of 5 g/m$^2$ and then dried. The resultant coating was super-calendered to give a heat-sensitive recording material.

Example 2

A heat-sensitive recording material was prepared in the same manner as in Example 1 except that the amounts of Dispersions B and C were changed as follows.

| | |
|---|---|
| Dispersion B | 7.5 parts |
| Dispersion C | 2.5 parts |

Example 3

A heat-sensitive recording material was prepared in the same manner as in Example 1 except that the amounts of Dispersions B and C were changed as follows.

| | |
|---|---|
| Dispersion B | 2.5 parts |
| Dispersion C | 7.5 parts |

Example 4

A heat-sensitive recording material was prepared in the same manner as in Example 1 except that the amounts of Dispersions B and C were changed as follows.

| | |
|---|---|
| Dispersion B | 9.5 parts |
| Dispersion C | 0.5 parts |

Example 5

A heat-sensitive recording material was prepared in the same manner as in Example 1 except that the amounts of Dispersions B and C were changed as follows.

| | |
|---|---|
| Dispersion B | 9.7 parts |
| Dispersion C | 0.3 parts |

Example 6

A heat-sensitive recording material was prepared in the same manner as in Example 1 except that Dispersion C was replaced with Dispersion D.

Example 7

A heat-sensitive recording material was prepared in the same manner as in Example 1 except that Dispersion B was replaced with Dispersion D.

Comparative Example 1

A heat-sensitive recording material was prepared in the same manner as in Example 1 except that the amount of Dispersion B was changed as follows and that Dispersion C was not added.

| | |
|---|---|
| Dispersion B | 10 parts |

Comparative Example 2

A heat-sensitive recording material was prepared in the same manner as in Example 1 except that the amount of Dispersion C was changed as follows and that Dispersion B was not added.

| | |
|---|---|
| Dispersion C | 10 parts |

Comparative Example 3

A heat-sensitive recording material was prepared in the same manner as in Example 1 except that Dispersions B and C were replaced with Dispersion D.

| | |
|---|---|
| Dispersion D | 10 parts |

Comparative Example 4

A heat-sensitive recording material was prepared in the same manner as in Example 1 except that Dispersion C was replaced with Dispersion E.

Comparative Example 5

A heat-sensitive recording material was prepared in the same manner as in Example 1 except that Dispersion B were replaced with Dispersion E.

Comparative Example 6

A heat-sensitive recording material was prepared in the same manner as in Example 1 except that Dispersion C was replaced with Dispersion F.

The heat-sensitive recording materials obtained in Examples 1 to 7 and Comparative Examples 1 to 6 were evaluated for various properties according to the following methods. Tables 1 and 2 show the results.

[Color-forming Sensitivity]

A heat-sensitive recording material was used with a thermal paper printing machine (thermal head resistance value 1,645 Ω) supplied by Ohkura Denki K. K. to carry out printing at a dot density of 8 dots/mm at a printing voltage of 21 V and for a pulse width of 1.0 ms, and a recorded image portion was measured for an optical density with a Macbeth RD918 (visual filter). A greater value of the optical density means superior color-forming sensitivity.

[Saturation Concentration]

A heat-sensitive recording material was used with a thermal paper printing machine (thermal head resistance value 1,645 Ω) supplied by Ohkura Denki K. K. to carry out printing at a dot density of 8 dots/mm at a printing voltage of 21 V and for a pulse width of 1.4 ms, and a recorded image portion was measured for an optical density with a Macbeth RD918 (visual filter). A greater value of the optical density means superior saturation concentration.

[Heat Durability]

A print having a recorded image printed for a pulse width of 1.0 ms and a ground portion (non-recorded portion) used in the evaluation of the color-forming sensitivity was allowed to stand in a 60° C./dry environment for 24 hours, and then the recorded portion and the ground portion were measured for an optical density with a Macbeth RD918 (visual filter). A greater value of the optical density in a recorded image portion means that a heat-sensitive recording material has superior retainability of an recorded image against heat. A smaller value of the optical density in a ground portion means that the ground portion is more free from ground fogging and is excellent in retainability of a ground against heat.

[Humidity Durability]

A print having a recorded image printed for a pulse width of 1.0 ms and a ground portion (non-recorded portion) used in the evaluation of the color-forming sensitivity was allowed to stand in a 40° C./90% RH environment for 24 hours, and then the recorded portion and the ground portion were measured for an optical density with a Macbeth RD918 (visual filter). A greater value of the optical density in a recorded image portion means that a heat-sensitive recording material has superior retainability of an recorded image against humidity. A smaller value of the optical density in a ground portion means that the ground portion is more free from ground fogging and is excellent in retainability of a ground against humidity.

[Plasticizer Durability]

A soft vinyl chloride sheet was tightly attached to a print having a recorded image printed for a pulse width of 1.0 ms and a ground portion (non-recorded portion) used in the evaluation of the color-forming sensitivity, the resultant laminate was allowed to stand in a 40° C./dry environment for 24 hours, and then the recorded portion and the ground portion were measured for an optical density with a Macbeth RD918 (visual filter). A greater value of the optical density in a recorded image portion means that a heat-sensitive recording material has superior retainability of an recorded image against a plasticiser. A smaller value of the optical density in a ground portion means that the ground portion is more free from ground fogging and is excellent in retainability of a ground against a plasticizer.

[Light Resistance]

A print having a recorded image printed for a pulse width of 1.0 ms and a ground portion (non-recorded portion) used in the evaluation of the color-forming sensitivity was allowed to stand under an environment exposed to 5,000 lux of a fluorescence lamp for 7 days, and the recorded portion and the ground portion were measured for an optical density with a Macbeth RD918 (visual filter). A greater value of the optical density in a recorded image portion means that a heat-sensitive recording material has superior retainability of an recorded image against light. A smaller value of the optical density in a ground portion means that the ground portion is more free from ground fogging and is excellent in retainability of a ground against light.

TABLE 1

| | Color-forming | Saturation | Heat durability | | Humidity durability | | Plasticizer durability | | Light resistance | |
|---|---|---|---|---|---|---|---|---|---|---|
| | sensitivity | concentration | Ground | Image | Ground | Image | Ground | Image | Ground | Image |
| Ex. 1 | 1.15 | 1.28 | 0.10 | 1.12 | 0.07 | 0.96 | 0.06 | 0.81 | 0.08 | 1.14 |
| Ex. 2 | 1.13 | 1.25 | 0.12 | 1.13 | 0.07 | 1.00 | 0.06 | 0.83 | 0.09 | 1.11 |
| Ex. 3 | 1.16 | 1.28 | 0.09 | 1.09 | 0.08 | 0.92 | 0.06 | 0.77 | 0.08 | 1.09 |
| Ex. 4 | 1.12 | 1.23 | 0.12 | 1.12 | 0.07 | 1.03 | 0.06 | 0.91 | 0.10 | 1.12 |
| Ex. 5 | 1.08 | 1.21 | 0.11 | 1.06 | 0.07 | 1.00 | 0.06 | 0.89 | 0.10 | 1.07 |
| Ex. 6 | 1.13 | 1.23 | 0.15 | 1.10 | 0.08 | 0.94 | 0.07 | 0.79 | 0.10 | 1.10 |
| Ex. 7 | 1.15 | 1.25 | 0.15 | 1.09 | 0.08 | 0.92 | 0.07 | 0.75 | 0.10 | 1.08 |

Ex. = Example

TABLE 2

| | Color-forming | Saturation | Heat durability | | Humidity durability | | Plasticizer durability | | Light resistance | |
|---|---|---|---|---|---|---|---|---|---|---|
| | sensitivity | concentration | Ground | Image | Ground | Image | Ground | Image | Ground | Image |
| CEx. 1 | 0.92 | 1.15 | 0.09 | 0.89 | 0.06 | 0.81 | 0.06 | 0.57 | 0.08 | 0.84 |
| CEx. 2 | 1.03 | 1.20 | 0.05 | 0.41 | 0.05 | 0.40 | 0.05 | 0.21 | 0.07 | 0.70 |
| CEx. 3 | 0.90 | 1.12 | 0.11 | 0.85 | 0.06 | 0.77 | 0.05 | 0.48 | 0.08 | 0.75 |
| CEx. 4 | 1.15 | 1.30 | 0.30 | 1.00 | 0.15 | 0.90 | 0.07 | 0.55 | 0.15 | 0.89 |
| CEx. 5 | 1.19 | 1.32 | 0.35 | 0.75 | 0.18 | 0.65 | 0.07 | 0.16 | 0.18 | 0.78 |
| CEx. 6 | 1.18 | 1.27 | 0.33 | 1.03 | 0.18 | 0.89 | 0.09 | 0.45 | 0.16 | 0.80 |

CEx. = Comparative Example

Evaluations:

The above Tables 1 and 2 show the following. The heat-sensitive recording materials of Examples 1 to 7 having heat-sensitive recording layers containing the dye precursor and 2 or more diphenylsulfone derivatives as electron-accepting compound which cause the dye precursor to form a color have excellent color-forming sensitivity and saturation density over the heat-sensitive recording materials of Comparative Examples 1 to 3 having heat-sensitive recording layers containing a single diphenylsulfone derivative. Further, the heat-sensitive recording materials of Examples 1 to 7 show less ground fogging than the heat-sensitive recording materials of Comparative Examples 4 to 6 in the heat durability, humidity durability and light resistance tests.

Further, the heat-sensitive recording materials of Examples 1 to 7 have excellent retainability of a recorded image over the counterparts of Comparative Examples 1 to 6 in the heat durability, humidity durability, plasticizer durability and light resistance tests. In the plasticizer durability and light resistance tests in particular, the heat-sensitive recording materials of Examples 1 to 7 materialize the recorded image retainability that has not yet been materialized when a single diphenylsulfone derivative is used, due to synergistic effects of the use of two or more diphenylsulfone derivatives which are electron-accepting compounds.

Example 8

(A) Preparation of Coating Solution for Forming Heat-sensitive Recording Layer

30 Parts of 3-(N,N'-dibutylamino)-6-methyl-7-anilinofluoran as a dye precursor which was to form the color of black was milled together with 69 parts of a 2.5% polyvinyl alcohol aqueous solution with a ball mill for 24 hours, to obtain a dye precursor dispersion. Further, 30 parts of 4,4'-dihydroxydiphenylsulfone, 20 parts of 4-hydroxy-4'-isopropoxydiphenylsulfone and 20 parts of bis-(3-allyl-4-hydroxyphenyl)sulfone as electron-accepting compounds and 70 parts of β-benzyloxynaphthalene as a sensitizer were milled together with 420 parts of a 2.5% polyvinyl alcohol aqueous solution with a sand mill, to obtain a dispersion containing electron-accepting compounds having a volume average particle diameter of 2 Am or less. The above two dispersions were mixed, and while the mixture was stirred, the following components were added to the mixture and fully mixed therewith, to give a coating solution for forming a heat-sensitive recording layer.

| | |
|---|---|
| 50% calcium carbonate aqueous dispersion | 180 parts |
| 40% zinc stearate aqueous dispersion | 25 parts |
| 10% polyvinyl alcohol aqueous solution | 272 parts |
| Water | 300 parts |

(B) Preparation of Substrate Paper for Heat-sensitive Recording Material

A coating solution having the following composition was coated on a wood-free paper having a basis weight of 40 g/m$^2$ so as to form a coating having a dry solid coating amount of 9 g/m$^2$, and the coating was dried to give a substrate paper.

| | |
|---|---|
| Calcined kaolin | 100 parts |
| 50% styrene-butadiene-based latex aqueous dispersion | 24 parts |
| Water | 200 parts |

(C) Preparation of Heat-sensitive Recording Material

The coating solution for a heat-sensitive recording layer, prepared in the above (A), was coated on the substrate paper prepared in the above (B) so as to form a coating having a solid coating amount of 4 g/m$^2$, and the coating was dried to give a heat-sensitive recording material.

Example 9

A heat-sensitive recording material was prepared in the same manner as in Example 8 except that the electron-accepting compounds were replaced with 30 parts of 4,4'-dihydroxydiphenylsulfone, 20 parts of bis-(3-allyl-4-hydroxyphenyl)sulfone and 20 parts by weight of 4-hydroxy-4'-benzyloxydiphenylsulfone.

Example 10

A heat-sensitive recording material was prepared in the same manner as in Example 8 except that the electron-accepting compounds were replaced with 30 parts of 4,4'-dihydroxydiphenylsulfone, 20 parts of bis-(3-allyl-4-hydroxyphenyl)sulfone and 20 parts by weight of 2,4'-dihydroxydiphenylsulfone.

Example 11

A heat-sensitive recording material was prepared in the same manner as in Example 8 except that the electron-accepting compounds were replaced with 30 parts of 4,4'-dihydroxydiphenylsulfone, 20 parts of 4-hydroxy-4'-isopropoxydiphenylsulfone and 20 parts by weight of 4-hydroxy-4'-benzyloxydiphenylsulfone.

Example 12

A heat-sensitive recording material was prepared in the same manner as in Example 8 except that the electron-accepting compounds were replaced with 60 parts of 4,4'-dihydroxydiphenylsulfone, 5 parts of bis-(3-allyl-4-hydroxyphenyl)sulfone and 5 parts by weight of 2,4'-dihydroxydiphenylsulfone.

Example 13

A heat-sensitive recording material was prepared in the same manner as in Example 8 except that the electron-accepting compounds were replaced with 10 parts of 4,4'-dihydroxydiphenylsulfone, 30 parts of bis-(3-allyl-4-hydroxyphenyl)sulfone and 30 parts by weight of 2,4'-dihydroxydiphenylsulfone.

Example 14

A heat-sensitive recording material was prepared in the same manner as in Example 8 except that the electron-accepting compounds were replaced with 40 parts of 4,4'-dihydroxydiphenylsulfone, 10 parts of 4-hydroxy-4'-isopropoxydiphenylsulfone, 10 parts of 4-hydroxy-4'-benzyloxydiphenylsulfone and 10 parts of bis-(3-allyl-4-hydroxyphenyl)sulfone (four electron-accepting compounds).

Example 15

A heat-sensitive recording material was prepared in the same manner as in Example 8 except that the electron-accepting compounds were replaced with 40 parts of 4,4'-dihydroxydiphenylsulfone, 10 parts of 4-hydroxy-4'-isopropoxydiphenylsulfone, 10 parts of bis-(3-allyl-4-hydroxyphenyl)sulfone and 10 parts of 2,4'-dihydroxydiphenylsulfone (four electron-accepting compounds).

Example 16

A heat-sensitive recording material was prepared in the same manner as in Example 8 except that the electron-accepting compounds were replaced with 40 parts of 4,4'-dihydroxydiphenylsulfone, 10 parts of 4-hydroxy-4'-isopropoxydiphenylsulfone, 10 parts of 4-hydroxy-4'-benzyloxydiphenylsulfone and 10 parts of 2,4'-dihydroxydiphenylsulfone (four electron-accepting compounds).

Example 17

A heat-sensitive recording material was prepared in the same manner as in Example 8 except that the electron-accepting compounds were replaced with 40 parts of 4,4'-dihydroxydiphenylsulfone, 10 parts of 4-hydroxy-4'-benzyloxydiphenylsulfone, 10 parts of bis-(3-allyl-4-hydroxyphenyl)sulfone and 10 parts of 2,4'-dihydroxydiphenylsulfone (four electron-accepting compounds).

Example 18

A heat-sensitive recording material was prepared in the same manner as in Example 8 except that the electron-accepting compounds were replaced with 35 parts of 4,4'-dihydroxydiphenylsulfone and 35 parts of 4-hydroxy-4'-isopropoxydiphenylsulfone (two electron-accepting compounds).

Example 19

A heat-sensitive recording material was prepared in the same manner as in Example 8 except that the electron-accepting compounds were replaced with 35 parts of 4,4'-dihydroxydiphenylsulfone and 35 parts of 2,4'-dihydroxydiphenylsulfone (two electron-accepting compounds).

Example 20

A heat-sensitive recording material was prepared in the same manner as in Example 8 except that the electron-accepting compounds were replaced with 35 parts of 4,4'-dihydroxydiphenylsulfone and 35 parts of 4-hydroxy-4'-benzyloxydiphenylsulfone (two electron-accepting compounds).

The heat-sensitive recording materials obtained in the above Examples 8 to 20 were calendered such that their heat-sensitive recording layer surfaces had a Bekk smoothness of 400 to 500 seconds. Then, the heat-sensitive recording materials were evaluated for various properties by the following methods. Table 3 shows the results.

[Thermal Response Test]

A printing test was carried out with a facsimile tester TH-PMD supplied by Ohkura Denki K. K. That is, a thermal head having a dot density of 8 dots/mm and a head resistance of 185 Ω was used, and printing was carried out at a head voltage of 12 V and for a pulse width of 0.6 ms or 0.8 ms. A recorded image portion was measured for an optical density with a Macbeth RD-918 reflection densitometer. A formed color density of at least 0.80 in a pulse width of 0.6 ms and a formed color density of at least 1.05 for a pulse width of 0.8 ms are required for practical use.

[Heat Durability Test of Image Portion]

A print having a recorded image printed for a pulse width of 0.8 ms and a non-recorded ground portion used in the evaluation of the thermal response was allowed to stand in a 60° C. environment for 24 hours, and then the recorded portion and the non-recorded ground portion were measured for an optical density with the Macbeth RD-918 reflection densitometer.

[Humidity and Heat Durability Test of Image Portion]

A print having a recorded image printed for a pulse width of 0.8 ms and a non-recorded ground portion used in the evaluation of the thermal response was allowed to stand in a 40° C./90% RH environment for 24 hours, and then the recorded portion and the non-recorded ground portion were measured for an optical density with the Macbeth RD918 reflection densitometer.

TABLE 3

| | Retainability of image portion | | | | | | Thermal response Pulse width (ms) | |
|---|---|---|---|---|---|---|---|---|
| | Before treatment | | Heat durability | | Heat and humidity durability | | | |
| | Dmax | Dmin | Dmax | Dmin | Dmax | Dmin | 0.6 | 0.8 |
| Ex. 8 | 1.22 | 0.06 | 1.24 | 0.16 | 1.26 | 0.20 | 1.05 | 1.22 |
| Ex. 9 | 1.21 | 0.05 | 1.22 | 0.12 | 1.22 | 0.09 | 1.03 | 1.21 |
| Ex. 10 | 1.25 | 0.06 | 1.28 | 0.14 | 1.27 | 0.12 | 0.99 | 1.25 |
| Ex. 11 | 1.25 | 0.05 | 1.27 | 0.13 | 1.38 | 0.09 | 1.00 | 1.25 |
| Ex. 12 | 1.19 | 0.05 | 1.21 | 0.07 | 1.19 | 0.10 | 0.90 | 1.19 |
| Ex. 13 | 1.24 | 0.07 | 1.27 | 0.19 | 1.25 | 0.31 | 1.00 | 1.24 |
| Ex. 14 | 1.24 | 0.09 | 1.27 | 0.14 | 1.28 | 0.24 | 0.92 | 1.24 |
| Ex. 15 | 1.26 | 0.11 | 1.30 | 0.18 | 1.27 | 0.26 | 0.92 | 1.26 |
| Ex. 16 | 1.21 | 0.10 | 1.20 | 0.11 | 1.31 | 0.10 | 0.96 | 1.21 |
| Ex. 17 | 1.20 | 0.10 | 1.23 | 0.12 | 1.24 | 0.09 | 0.94 | 1.20 |
| Ex. 18 | 1.11 | 0.07 | 0.82 | 0.12 | 1.04 | 0.06 | 0.72 | 1.11 |
| Ex. 19 | 1.16 | 0.07 | 1.00 | 0.10 | 1.12 | 0.08 | 0.53 | 1.16 |
| Ex. 20 | 1.15 | 0.06 | 1.05 | 0.10 | 1.12 | 0.07 | 0.83 | 1.15 |

Ex. = Example
Dmax = density of recorded portion printed at 0.8 ms.
Dmin = density of non-recorded ground portion.

The heat-sensitive recording materials of Examples 8 to 13 have heat-sensitive recording layers containing three electron-accepting compounds each, the heat-sensitive recording materials of Examples 14 to 17 have heat-sensitive recording layers containing four electron-accepting compounds each, and the heat-sensitive recording materials of Examples 18 to 20 have heat-sensitive recording layers containing two electron-accepting compounds each. It is seen that the heat-sensitive recording materials having heat-sensitive recording layers containing three or four electron-accepting compounds show excellent performances over the heat-sensitive recording materials having heat-sensitive recording layer containing two electron-accepting compounds.

Example 21

(A) Preparation of Coating Solution for Forming Heat-sensitive Recording Layer

30 Parts of 3-(N,N'-dibutylamino)-6-methyl-7-anilinofluoran as a dye precursor which was to form the color of black was milled together with 69 parts of a 2.5% polyvinyl alcohol aqueous solution with a ball mill for 24 hours, to obtain a dye precursor dispersion. Further, 20 parts of 4,4'-dihydroxydiphenylsulfone and 50 parts of benzyl p-hydroxybenzoate as electron-accepting compounds and 70 parts of β-benzyloxynaphthalene as a sensitizer were milled together with 420 parts of a 2.5% polyvinyl alcohol aqueous solution with a sand mill, to obtain a dispersion containing electron-accepting compounds having a volume average particle diameter of 2 μm or less. The above two dispersions were mixed, and while the mixture was stirred, the following components were added to the mixture and fully mixed therewith, to give a coating solution for forming a heat-sensitive recording layer.

| | |
|---|---|
| 50% calcium carbonate aqueous dispersion | 180 parts |
| 40% zinc stearate aqueous dispersion | 25 parts |
| 10% polyvinyl alcohol aqueous solution | 272 parts |
| Water | 300 parts |

(B) Preparation of Substrate Paper for Heat-sensitive Recording Material

A coating solution having the following composition was coated on a wood-free paper having a basis weight of 40 g/M$^2$ so as to form a coating having a dry solid coating amount of 9 g/m$^2$, and the coating was dried to give a substrate paper.

| | |
|---|---|
| Calcined kaolin | 100 parts |
| 50% styrene-butadiene-based latex aqueous dispersion | 24 parts |
| Water | 200 parts |

(C) Preparation of Heat-sensitive Recording Material

The coating solution for a heat-sensitive recording layer, prepared in the above (A), was coated on the substrate paper prepared in the above (B) so as to form a coating having a solid coating amount of 4 g/m$^2$, and the coating was dried to give a heat-sensitive recording material.

Example 22

A heat-sensitive recording material was prepared in the same manner as in Example 21 except that the amounts of the electron-accepting compounds were changed as follows. 35 Parts of 4,4'-dihydroxydiphenylsulfone and 35 parts of benzyl p-hydroxybenzoate.

Example 23

A heat-sensitive recording material was prepared in the same manner as in Example 21 except that the amounts of the electron-accepting compounds were changed as follows. 50 Parts of 4,4'-dihydroxydiphenylsulfone and 20 parts of benzyl p-hydroxybenzoate.

Example 24

A heat-sensitive recording material was prepared in the same manner as in Example 21 except that the amounts of the electron-accepting compounds were changed as follows. 60 Parts of 4,4'-dihydroxydiphenylsulfone and 10 parts of benzyl p-hydroxybenzoate.

Example 25

A heat-sensitive recording material was prepared in the same manner as in Example 21 except that the amounts of the electron-accepting compounds were changed to 35 parts of 4,4'-dihydroxydiphenylsulfone and 33.3 parts of benzyl p-hydroxybenzoate and that 17 parts of sodium-2,2'-methylene-bis(4,6-di-tert-butylphenyl)hydrogen phosphate, which is a phosphate ester derivative, was newly added.

Example 26

A heat-sensitive recording material was prepared in the same manner as in Example 21 except that the amounts of the electron-accepting compounds were changed to 35 parts of 4,4'-dihydroxydiphenylsulfone and 33.3 parts of benzyl p-hydroxybenzoate and that 20 parts of 2,2'-methylene-bis(4-methyl-6-tert-butylphenol), which is a phenol derivative, was newly added.

Comparative Example 7

A heat-sensitive recording material was obtained in the same manner as in Example 21 except that the amount of 4,4'-dihydroxydipehnylsulfone as an electron-accepting compound was changed to 70 parts and that benzyl p-hydroxybenzoate was removed.

Comparative Example 8

A heat-sensitive recording material was obtained in the same manner as in Example 21 except that 4,4'-dihydroxydipehnylsulfone was removed and that the amount of benzyl p-hydroxybenzoate as an electron-accepting compound was changed to 70 parts.

The heat-sensitive recording materials obtained in Examples 21 to 26 and Comparative Examples 7 and 8 were calendered such that their heat-sensitive recording layer surfaces had a Bekk smoothness of 400 to 500 seconds. Then, the heat-sensitive recording materials were evaluated for various properties by the following methods. Tables 4, 5 and 6 show the results.

[Thermal Response Test]

A printing test was carried out with a facsimile tester TH-PMD supplied by Ohkura Denki K. K. That is, a thermal head having a dot density of 8 dots/mm and a head resistance of 185 Ω was used, and printing was carried out at a head voltage of 12 V and for a pulse width of 0.8 ms or 1.0 ms. A recorded image portion was measured for an optical density with a Macbeth RD-918 reflection densitometer. A formed color density of at least 0.80 in a pulse width of 0.8 ms and a formed color density of at least 1.05 in a pulse width of 1.0 ms are required for practical use.

[Heat Durability Test of Image Portion]

A print having a recorded image printed for a pulse width of 0.8 ms or 1.0 ms and a non-recorded ground portion used in the evaluation of the thermal response was allowed to stand in a 60° C. environment for 24 hours, and then the recorded image portion and the non-recorded ground portion were measured for an optical density with the Macbeth RD-918 reflection densitometer.

[Humidity and Heat Durability Test of Image Portion]

A print having a recorded image printed for a pulse width of 0.8 ms or 1.0 ms and a non-recorded ground portion used in the evaluation of the thermal response was allowed to stand in a 40° C./90% RH environment for 24 hours, and then the recorded portion and the non-recorded ground portion were measured for an optical density with the Macbeth RD-918 reflection densitometer.

[Accelerated Heat Durability Test of Image Portion]

A print having a recorded image printed for a pulse width of 0.8 ms or 1.0 ms and a non-recorded ground portion used in the evaluation of the thermal response was allowed to stand in a 40° C. environment for 168 hours, and then the recorded portion and the non-recorded ground portion were measured for an optical density with the Macbeth RD-918 reflection densitometer.

[Water Resistance Hest of Image Portion]

A print having a recorded image printed for a pulse width of 0.8 ms or 1.0 ms and a non-recorded ground portion used in the evaluation of the thermal response was immersed in pure water at room temperature for 24 hours, and excess water was removed with a blotting paper. The print was naturally dried at room temperature, and then the recorded portion and the non-recorded ground portion were measured for an optical density with the Macbeth RD-918 reflection densitometer.

TABLE 4

| Printing energy | Thermal response ms 0.8 | 1.0 |
|---|---|---|
| Example 21 | 1.15 | 1.27 |
| Example 22 | 1.15 | 1.30 |
| Example 23 | 1.07 | 1.28 |
| Example 24 | 0.92 | 1.24 |
| Example 25 | 1.20 | 1.32 |
| Example 26 | 1.13 | 1.25 |
| Comparative Example 27 | 0.62 | 0.98 |
| Comparative Example 28 | 1.21 | 1.31 |

Example 27

(A) Preparation of Coating Solution for Forming Heat-sensitive Recording Layer

30 Parts of 3-(N,N'-dibutylamino)-6-methyl-7-anilinofluoran as a dye precursor which was to form the color of black was milled together with 70 parts of a 2.5% polyvinyl alcohol aqueous solution with a ball mill for 24 hours, to obtain a dye precursor dispersion. Further, 65 parts of benzyl 4-hydroxybenzoate and 5 parts of 2,2'-bis{4-(4-hydroxyphenylsulfonyl)phenoxy}diethyl ether as electron-accepting compounds and 70 parts of benzyl-2-naphthyl ether as a sensitizer were milled together with 420 parts of a 2.5% polyvinyl alcohol aqueous solution with a sand mill, to obtain a dispersion containing electron-accepting compounds having a volume average particle diameter of 2 $\mu$m or less. The above two dispersions were mixed, and while the mixture was stirred, the following components were added to the mixture and fully mixed therewith, to give a coating solution for forming a heat-sensitive recording layer.

TABLE 5

| | Retainability of image portion | | | | | | | | | |
|---|---|---|---|---|---|---|---|---|---|---|
| | Before treatment | | Heat durability | | Heat and humidity durability | | Accelerated heat durability | | Water resistance | |
| | Dmax | Dmin | Dmax | Dmin | Dmax | Dmin | Dmax | Dmin | Dmax | Dmin |
| Ex. 21 | 1.15 | 0.06 | 0.55 | 0.13 | 0.62 | 0.08 | 0.55 | 0.07 | 0.49 | 0.05 |
| Ex. 22 | 1.15 | 0.07 | 0.89 | 0.14 | 1.02 | 0.09 | 0.93 | 0.07 | 0.47 | 0.05 |
| Ex. 23 | 1.07 | 0.08 | 0.82 | 0.17 | 1.07 | 0.11 | 0.88 | 0.08 | 0.46 | 0.05 |
| Ex. 24 | 0.92 | 0.08 | 0.58 | 0.14 | 1.02 | 0.09 | 0.74 | 0.09 | 0.42 | 0.05 |
| Ex. 25 | 1.20 | 0.08 | 0.97 | 0.18 | 1.05 | 0.09 | 1.02 | 0.08 | 0.69 | 0.05 |
| Ex. 26 | 1.13 | 0.06 | 1.00 | 0.15 | 1.07 | 0.09 | 1.05 | 0.08 | 1.03 | 0.05 |
| CEx. 7 | 0.62 | 0.05 | 0.44 | 0.07 | 0.89 | 0.05 | 0.87 | 0.05 | 0.16 | 0.05 |
| CEx. 8 | 1.21 | 0.06 | 0.20 | 0.07 | 0.22 | 0.06 | 0.15 | 0.06 | 0.09 | 0.06 |

Ex. = Example,
CEx. = Comparative Example
Dmax = density of recorded portion printed at 0.8 ms.
Dmin = density of non-recorded ground portion

TABLE 6

| | Retainability of image portion | | | | | | | | | |
|---|---|---|---|---|---|---|---|---|---|---|
| | Before treatment | | Heat durability | | Heat and humidity durability | | Accelerated heat durability | | Water resistance | |
| | Dmax | Dmin | Dmax | Dmin | Dmax | Dmin | Dmax | Dmin | Dmax | Dmin |
| Ex. 21 | 1.27 | 0.06 | 0.71 | 0.13 | 0.73 | 0.08 | 0.70 | 0.07 | 0.73 | 0.05 |
| Ex. 22 | 1.30 | 0.07 | 1.20 | 0.14 | 1.23 | 0.09 | 1.23 | 0.07 | 0.76 | 0.05 |
| Ex. 23 | 1.28 | 0.08 | 1.24 | 0.17 | 1.25 | 0.11 | 1.26 | 0.08 | 0.72 | 0.05 |
| Ex. 24 | 1.24 | 0.08 | 1.23 | 0.14 | 1.24 | 0.09 | 1.18 | 0.09 | 0.70 | 0.05 |
| Ex. 25 | 1.32 | 0.08 | 1.24 | 0.18 | 1.21 | 0.09 | 1.25 | 0.08 | 1.09 | 0.05 |
| Ex. 26 | 1.25 | 0.06 | 1.23 | 0.15 | 1.22 | 0.09 | 1.22 | 0.08 | 1.21 | 0.05 |
| CEx. 7 | 0.98 | 0.05 | 0.96 | 0.07 | 0.95 | 0.05 | 0.90 | 0.05 | 0.32 | 0.05 |
| CEx. 8 | 1.31 | 0.06 | 0.21 | 0.07 | 0.23 | 0.06 | 0.17 | 0.06 | 0.13 | 0.06 |

Ex. = Example,
CEx. = Comparative Example
Dmax = density of recorded portion printed at 1.0 ms.
Dmin = density of non-recorded ground portion

| | |
|---|---|
| 50% calcium carbonate aqueous dispersion | 60 parts |
| 40% zinc stearate aqueous dispersion | 15 parts |
| 10% polyvinyl alcohol aqueous solution | 250 parts |
| Water | 200 parts |

(B) Preparation of Substrate Paper for Heat-sensitive Recording Material

A coating solution having the following composition was coated on a wood-free paper having a basis weight of 40 g/m$^2$ so as to form a coating having a dry solid coating amount of 10 g/m$^2$, and the coating was dried to give a substrate paper.

| | |
|---|---|
| Calcined kaolin | 100 parts |
| 50% styrene-butadiene-based latex aqueous dispersion | 24 parts |
| Water | 200 parts |

(C) Preparation of Heat-sensitive Recording Material

The coating solution for a heat-sensitive recording layer, prepared in the above (A), was coated on the substrate paper prepared in the above (B) so as to form a coating having a dye precursor coating amount of 0.4 g/m$^2$, and the coating was dried to give a heat-sensitive recording material.

Example 28

A heat-sensitive recording material was prepared in the same manner as in Example 27 except that 5 parts of 2,2'-bis{4-(4-hydroxyphenylsulfonyl)phenoxy}diethyl ether in the preparation of coating solution for forming heat-sensitive recording layer was replaced with 2.5 parts of 2,2'-bis{4-(4-hydroxyphenylsulfonyl)phenoxyldiethyl ether and 2.5 parts of 4,4'-bis(4-(4-hydroxyphenylsulfonyl)-phenoxy-2-ethyloxy}diphenylsulfone.

Example 29

A heat-sensitive recording material was prepared in the same manner as in Example 28 except that the electron-accepting compounds in the preparation of coating solution for heat-sensitive recording layer were replaced with 60 parts of benzyl 4-hydroxybenzoate, 5 parts of 2,2'-bis{4-(4-hydroxyphenylsulfonyl)phenoxy}diethyl ether and 5 parts of 4,4'-bis{4-(4-hydroxyphenylsulfonyl)phenoxy-2-ethyloxy}diphenylsulfone.

Example 30

A heat-sensitive recording material was prepared in the same manner as in Example 28 except that the electron-accepting compounds in the preparation of coating solution for forming heat-sensitive recording layer were replaced with 50 parts of benzyl 4-hydroxybenzoate, 10 parts of 2,2'-bis{4-(4-hydroxyphenylsulfonyl)phenoxy}-diethyl ether and 10 parts of 4,4'-bis{4-(4-hydroxyphenylsulfonyl) phenoxy-2-ethyloxy}diphenylsulfone.

Example 31

A heat-sensitive recording material was prepared in the same manner as in Example 30 except that 0.7 part of sodium-2,2'-methylenebis(4,6-di-tert-butylphenyl)hydrogen phosphate was added to the same dispersion as the dispersion containing the electron-accepting compounds in the preparation of heat-sensitive recording layer in Example 30, together with 2.1 parts of a 2.5% polyvinyl alcohol aqueous solution.

Example 32

A heat-sensitive recording material was prepared in the same manner as in Example 30 except that 7 parts of sodium-2,2'-methylenebis (4, 6-di-tert-butylphenyl) hydrogen phosphate was added to the same dispersion as the dispersion containing the electron-accepting compounds in the preparation of heat-sensitive recording layer in Example 30, together with 21 parts of a 2.5% polyvinyl alcohol aqueous solution.

Example 33

A heat-sensitive recording material was prepared in the same manner as in Example 30 except that 10 parts of salicylanilide was added to the same dispersion as the dispersion containing the electron-accepting compounds in the preparation of heat-sensitive recording layer in Example 30, together with 30 parts of a 2.5% polyvinyl alcohol aqueous solution.

Example 34

A heat-sensitive recording material was prepared in the same manner as in Example 31 except that 10 parts of salicylanilide was added to the same dispersion as the dispersion containing the electron-accepting compounds in the preparation of heat-sensitive recording layer in Example 31, together with 30 parts of a 2.5% polyvinyl alcohol aqueous solution.

Example 35

A heat-sensitive recording material was prepared in the same manner as in Example 28 except that the amount of the electron-accepting compounds in the preparation of coating solution for forming heat-sensitive recording layer were changed to 35 parts of benzyl 4-hydroxybenzoate, 17.5 parts of 2,2'-bis{4-(4-hydroxyphenylsulfonyl)phenoxy}-diethyl ether and 17.5 parts of 4,4'-bis{4-(4-hydroxyphenylsulfonyl)phenoxy-2-ethyloxy}diphenylsulfone.

Example 36

A heat-sensitive recording material was prepared in the same manner as in Example 28 except that the amount of the electron-accepting compounds in the preparation of coating solution for forming heat-sensitive recording layer were changed to 20 parts of benzyl 4-hydroxybenzoate, 25 parts of 2,2'-bis{4-(4-hydroxyphenylsulfonyl)phenoxy}-diethyl ether and 25 parts of 4,4'-bis{4-(4-hydroxyphenylsulfonyl) phenoxy-2-ethyloxy}diphenylsulfone.

Comparative Example 9

A heat-sensitive recording material was prepared in the same manner as in Example 27 except that the electron-accepting compounds in the preparation of coating solution for forming heat-sensitive recording layer were limited to 70 parts of benzyl 4-hydroxybenzoate alone.

Comparative Example 10

A heat-sensitive recording material was prepared in the same manner as in Example 27 except that the electron-accepting compounds in the preparation of coating solution for forming heat-sensitive recording layer were limited to 70 parts of 2,2'-bis{4-(4-hydroxyphenylsulfonyl) phenoxy}diethyl ether.

Comparative Example 11

A heat-sensitive recording material was prepared in the same manner as in Example 27 except that the electron-accepting compounds in the preparation of coating solution for forming heat-sensitive recording layer were replaced with 35 parts of 2,2'-bis{4-(4-hydroxyphenyl-sulfonyl) phenoxy}diethyl ether and 35 parts of 4,4'-bis{4-(4-hydroxyphenylsulfonyl)phenoxy-2-ethyloxy}diphenylsulfone.

The heat-sensitive recording materials obtained in Examples 27 to 36 and Comparative Examples 9 to 11 were calendered such that their heat-sensitive recording layer surfaces had a Bekk smoothness of 400 to 800 seconds. Then, the heat-sensitive recording materials were evaluated for various properties by the following methods. Tables 7 and 8 show the results.

[Thermal Response Test]

A printing test was carried out in the same manner as in the printing test of the heat-sensitive recording materials of Examples 8 to 20 except that the pulse width was changed to 0.8 ms or 1.0 ms. A formed color density of at least 0.80 in a pulse width of 0.8 ms and a formed color density of at least 1.05 for a pulse width of 1.0 ms are required for practical use. A greater value of the formed color density means superior thermal response.

[Heat Durability Test]

A print having a recorded image printed for a pulse width of 1.0 ms and a non-recorded ground portion used in the evaluation of the thermal response was allowed to stand in a 60° C. environment for 24 hours, and then the recorded portion and the non-recorded ground portion were measured for an optical density with the Macbeth RD-918 reflection densitometer (visual filter). A greater value of the optical density in a recorded image portion means that a heat-sensitive recording material has superior retainability of an recorded image against heat. A smaller value of the optical density in a ground portion means that the ground portion is more free from ground fogging and is excellent in retainability of a ground against heat.

[Humidity Durability Test]

A print having a recorded image printed for a pulse width of 1.0 ms and a non-recorded ground portion used in the evaluation of the thermal response was allowed to stand in a 40° C./90% RH environment for 24 hours, and then the recorded portion and the non-recorded ground portion were measured for an optical density with the Macbeth RD-918 reflection densitometer (visual filter). A greater value of the optical density in a recorded image portion means that a heat-sensitive recording material has superior retainability of an recorded image against humidity. A smaller value of the optical density in a ground portion means that the ground portion is more free from ground fogging and is excellent in retainability of a ground against humidity.

[Plasticizer Durability Test]

A soft vinyl chloride sheet was tightly attached to a print having a recorded image printed for a pulse width of 1.0 ms and a non-recorded ground portion used in the evaluation of the thermal response, the resultant laminate was allowed to stand in a 40° C. environment for 24 hours, and then the recorded portion and the ground portion were measured for an optical density with a Macbeth RD-918 reflection densitometer (visual filter). A greater value of the optical density in a recorded image portion means that a heat-sensitive recording material has superior retainability of an recorded image against a plasticiser. A smaller value of the optical density in a ground portion means that the ground portion is more free from ground fogging and is excellent in retainability of a ground against a plasticizer.

TABLE 7

| | Thermal Response | | | Heat durability | | Humidity durability | | Plasticizer durability | |
|---|---|---|---|---|---|---|---|---|---|
| | Gr. | 0.8 (ms) | 1.0 (ms) | Gr. | Image | Gr. | Image | Gr. | Image |
| Ex. 27 | 0.07 | 1.20 | 1.27 | 0.13 | 0.94 | 0.06 | 0.77 | 0.06 | 0.54 |
| Ex. 28 | 0.07 | 1.20 | 1.28 | 0.14 | 0.95 | 0.07 | 0.79 | 0.06 | 0.56 |
| Ex. 29 | 0.06 | 1.17 | 1.25 | 0.15 | 0.98 | 0.06 | 0.81 | 0.06 | 0.60 |
| Ex. 30 | 0.07 | 1.14 | 1.20 | 0.15 | 1.09 | 0.09 | 0.90 | 0.08 | 0.84 |
| Ex. 31 | 0.07 | 1.15 | 1.25 | 0.16 | 1.15 | 0.09 | 0.95 | 0.08 | 0.90 |
| Ex. 32 | 0.07 | 1.15 | 1.26 | 0.17 | 1.17 | 0.09 | 0.97 | 0.09 | 0.92 |
| Ex. 33 | 0.08 | 1.23 | 1.32 | 0.19 | 1.20 | 0.10 | 1.00 | 0.08 | 0.94 |
| Ex. 34 | 0.08 | 1.25 | 1.35 | 0.20 | 1.25 | 0.10 | 1.06 | 0.08 | 1.02 |
| Ex. 35 | 0.09 | 1.08 | 1.15 | 0.19 | 1.07 | 0.11 | 0.95 | 0.09 | 0.80 |
| Ex. 36 | 0.06 | 0.90 | 1.07 | 0.12 | 0.95 | 0.07 | 0.90 | 0.08 | 0.75 |

Ex. = Example,
Gr = Ground

TABLE 8

| | Thermal Response | | | Heat durability | | Humidity durability | | Plasticizer durability | |
|---|---|---|---|---|---|---|---|---|---|
| | Gr. | 0.8 (ms) | 1.0 (ms) | Gr. | Image | Gr. | Image | Gr. | Image |
| CEx. 9 | 0.09 | 1.21 | 1.31 | 0.17 | 0.88 | 0.08 | 0.66 | 0.09 | 0.15 |
| CEx. 10 | 0.07 | 0.29 | 0.60 | 0.10 | 0.50 | 0.08 | 0.55 | 0.08 | 0.52 |
| CEx. 11 | 0.07 | 0.30 | 0.62 | 0.10 | 0.53 | 0.08 | 0.56 | 0.08 | 0.54 |

CEx. = Comparative Example,
Gr = Ground

Tables 7 and 8 clear show that the heat-sensitive recording materials of Examples 27 to 36 show thermal response sufficient for practical use and have excellent retainability of a recorded image against heat, against humidity and against a plasticizer over the heat-sensitive recording material of Comparative Example 9. Further, it is shown that the heat-sensitive recording materials of Examples 27 to 36 show remarkably excellent thermal response over the counterparts of Comparative Examples 10 and 11, so that the heat-sensitive recording materials of Examples 27 to 36 are well-balanced between thermal response and retainability of recorded-images and are excellent heat-sensitive recording materials due to synergistic effects of the diphenylsulfone derivative of the formula (IV) and the hydroxybenzoic acid derivative of the formula (III) as electron-accepting compounds.

The heat-sensitive recording materials of Examples 31 and 32 show higher thermal response, and have higher retainability of recorded images against heat and humidity, than the heat-sensitive recording material of Example 30. The reason therefor is assumed to be that the compatibility between the dye precursor and the electron-accepting compound is improved by the co-presence of the phosphate ester of the formula (V).

Further, the heat-sensitive recording materials of Examples 33 and 34 are imparted with higher thermal response by containing the salicylamide derivative of the formula (VI).

Example 37

(A) Preparation of Coating Solution for Forming Heat-sensitive Recording Layer

35 Parts of 3-(N,N'-dibutylamino)-6-methyl-7-anilinofluoran as a dye precursor which was to form the color of black was milled together with 80 parts of a 2.5% polyvinyl alcohol aqueous solution with a ball mill for 24 hours, to obtain a dye precursor dispersion. Further, 40 parts of 4-hydroxy-4'-isopropoxydiphenylsulfone as an electron-accepting compound and 60 parts of bis(4-methoxyphenyl) ether as a sensitizer were milled together with 300 parts of a 2.5% polyvinyl alcohol aqueous solution with a DYNO-MILL (sand mill supplied by WEB), to obtain a dispersion containing the electron-accepting compound having a volume average particle diameter of 2 μm or less and the sensitizer. The above two dispersions were mixed, and while the mixture was stirred, the following components were added to the mixture and fully mixed therewith, to give a coating solution for forming a heat-sensitive recording layer.

| | |
|---|---|
| 50% calcium carbonate aqueous dispersion | 100 parts |
| 40% zinc stearate aqueous dispersion | 25 parts |
| 10% polyvinyl alcohol aqueous solution | 200 parts |
| Water | 280 parts |

(B) Preparation of Substrate Paper for Heat-sensitive Recording Material

A coating solution having the following composition was coated on a wood-free paper having a basis weight of 40 g/m$^2$ so as to form a coating having a dry solid coating amount of 9 g/m$^2$, and the coating was dried to give a substrate paper.

| | |
|---|---|
| Calcined kaolin | 100 parts |
| 50% styrene-butadiene-based latex aqueous dispersion | 24 parts |
| Water | 200 parts |

(C) Preparation of Heat-sensitive Recording Material

The coating solution for a heat-sensitive recording layer, prepared in the above (A), was coated on the substrate paper prepared in the above (B) so as to form a coating having a solid coating amount of 4 g/m$^2$, and the coating was dried to give a heat-sensitive recording material.

Comparative Example 12

A heat-sensitive recording material was prepared in the same manner as in Example 37 except that bis(4-methoxyphenyl)ether was replaced with benzyl-β-naphthyl ether.

Comparative Example 13

A heat-sensitive recording material was prepared in the same manner as in Example 37 except 4-hydroxy-4'-isopropoxydiphenylsulfone was replaced with 2,2-bis(4-hydroxyphenyl)propane.

The heat-sensitive recording materials obtained in Example 37 and Comparative Examples 12 and 13 were calendered such that their heat-sensitive recording layer surfaces had a Bekk smoothness of 400 to 500 seconds. Then, the heat-sensitive recording materials were evaluated for various properties by the following methods. Table 9 shows the results.

[Color-forming Sensitivity Test]

A printing test was carried out with a facsimile tester TH-PMD supplied by Ohkura Denki K. K. That is, a thermal head having a dot density of 8 dots/mm and a head resistance of 1,290 Ω was used, and printing was carried out at a head voltage of 21 V and for a pulse width of 0.7 ms and 1.0 ms. A recorded image portion was measured for a formed color density with a Macbeth RD-918 reflection densitometer. A formed color density of at least 0.60 in a pulse width of 0.7 ms and a formed color density of at least 1.15 in a pulse width of 1.0 ms are required for practical use.

[Heat Durability Test of Image Portion]

A print having a recorded image printed for a pulse width of 1.0 ms used in the evaluation of the color-forming sensitivity was allowed to stand in a 60° C. environment for 24 hours, and then the recorded image portion was measured for a density with the Macbeth RD-918 reflection densitometer. The value of the found density was divided by a density value found before the heat durability test, and parenthesized values show remaining ratios (%).

[Humidity and Heat Durability Test of Image Portion]

A print having a recorded image printed for a pulse width of 1.0 ms used in the evaluation of the color-forming sensitivity was allowed to stand in a 60° C./90% RH environment for 24 hours, and then the recorded image portion was measured for a density with the Macbeth RD-918 reflection densitometer. The value of the found density was divided by a density value found before the humidity and heat durability test, and parenthesized values show remaining ratios (%).

[Wrapping Durability Test of Image Portion]

A commercially available wrapping film was covered on an recorded image portion of a print having the recorded image printed for a pulse width of 1.0 ms used in the evaluation of the color-forming sensitivity, and a load of 20 mN/cm$^2$ was placed thereon. In this state, the print was allowed to stand in a 40° C. environment for 24 hours, and the recorded image portion was measured for a density with the Macbeth RD-918 reflection densitometer. The value of the found density was divided by a density value found before the wrapping durability test, and parenthesized values show remaining ratios (%).

TABLE 9

| | Color-forming sensitivity | | Retainability of image portion | | |
|---|---|---|---|---|---|
| | | | Heat | Heat and humidity | Wrapping |
| | 0.7 ms | 1.0 ms | durability | durability | durability |
| Ex. 37 | 0.73 | 1.32 | 1.27 (96) | 0.98 (75) | 0.66 (50) |
| CEx. 12 | 0.58 | 1.16 | 1.11 (96) | 0.86 (74) | 0.53 (46) |
| CEx. 13 | 0.71 | 1.31 | 0.96 (73) | 0.82 (63) | 0.22 (17) |

Ex. = Example,
CEx. = Comparative Example
Parenthesized values show remaining ratios (%).

As shown in Table 9, the heat-sensitive recording material of Example 37 are excellent in both the color-forming sensitivity and the retainability of recorded images over the counterparts of Comparative Examples 12 and 13. The heat-sensitive recording material of Comparative Example 12 is poor in the color-forming sensitivity, and the heat-sensitive recording material of Comparative Example 13 has good color-forming sensitivity but is poor in the retainability of recorded images.

Preparation Example 2

Preparation of Dispersion

<Dispersion A-1>

200 Grams of 3-di-n-butylamino-6-methyl-7-anilinofluoran (melting point 182° C.) was dispersed in a mixture of 200 g of a 10% polyvinyl alcohol aqueous solution and 600 g of water, and milled with a bead mill until it had an average particle diameter of 0.8 μm.

<Dispersion A-2>

200 Grams of 3-dibutylamino-7-(o-chloroanilino)fluoran (melting point 186° C.) was dispersed in a mixture of 200 g of a 10% polyvinyl alcohol aqueous solution and 600 g of water, and milled with a bead mill until it had an average particle diameter of 0.8 μm.

<Dispersion A-3>

200 Grams of 3-diethylamino-7-(m-trifluoromethylanilino)fluoran (melting point 181° C.) was mixture of 200 g of a 10% polyvinyl alcohol on and 600 g of water, and milled with a bead had an average particle diameter of 0.8 μm.

<Dispersion A-4>

200 Grams of 3-(N-ethyl-N-p-tolyl)amino-6-methyl-7-anilinofluoran (melting point 207° C.) was dispersed in a mixture of 200 g of a 10% polyvinyl alcohol aqueous solution and 600 g of water, and milled with a bead mill until it had an average particle diameter of 0.8 μm.

<Dispersion A-5>

200 Grams of 3-(N-ethyl-N-isobutyl)amino-6-methyl-7-anilinofluoran (melting point 164° C.) was dispersed in a mixture of 200 g of a 10% polyvinyl alcohol aqueous solution and 600 g of water, and milled with a bead mill until it had an average particle diameter of 0.8 μm.

<Dispersion B-1>

200 Grams of 4,4'-dihydroxydiphenylsulfone (melting point 249° C.) was dispersed in a mixture of 200 g of a 10% polyvinyl alcohol aqueous solution and 600 g of water, and milled with a bead mill until it had an average particle diameter of 0.8 μm.

<Dispersion B-2>

200 Grams of 4-hydroxy-4'-isopropoxy-diphenylsulfone (melting point 130° C.) was dispersed in a mixture of 200 g of a 10% polyvinyl alcohol aqueous solution and 600 g of water, and milled with a bead mill until it had an average particle diameter of 0.8 μm.

<Dispersion B-3>

200 Grams of 4-hydroxy-4'-n-propoxy-diphenylsulfone (melting point 153° C.) was dispersed in a mixture of 200 g of a 10% polyvinyl alcohol aqueous solution and 600 g of water, and milled with a bead mill until it had an average particle diameter of 0.8 μm.

<Dispersion B-4>

200 Grams of 2,2-bis(p-hydroxyphenyl)propane was dispersed in a mixture of 200 g of a 10% polyvinyl alcohol aqueous solution and 600 g of water, and milled with a bead mill until it had an average particle diameter of 0.8 μm.

<Dispersion B-5>

200 Grams of 1,1-bis(p-hydroxyphenyl)cyclohexane was dispersed in a mixture of 200 g of a 10% polyvinyl alcohol aqueous solution and 600 g of water, and milled with a bead mill until it had an average particle diameter of 0.8 μm.

<Dispersion C-1>

200 Grams of 5-tert-butylsalicyl-m-methylthioanilide was dispersed in a mixture of 200 g of a 10% polyvinyl alcohol aqueous solution and 600 g of water, and milled with a bead mill until it had an average particle diameter of 0.8 μm.

<Dispersion C-2>

200 Grams of 5-tert-butylsalicyl-p-methoxyanilide was dispersed in a mixture of 200 g of a 10% polyvinyl alcohol aqueous solution and 600 g of water, and milled with a bead mill until it had an average particle diameter of 0.8 μm.

<Dispersion C-3>

200 Grams of 1-(4-methylphenoxy)-2-(2-naphthoxy) ethane was dispersed in a mixture of 200 g of a 10% polyvinyl alcohol aqueous solution and 600 g of water, and milled with a bead mill until it had an average particle diameter of 0.8 μm.

<Dispersion C-4>

200 Grams of di(p-methylbenzyl)oxalate was dispersed in a mixture of 200 g of a 10% polyvinyl alcohol aqueous solution and 600 g of water, and milled with a bead mill until it had an average particle diameter of 0.8 μm.

<Dispersion C-5>

200 Grams of benzyl-2-naphthyl ether was dispersed in a mixture of 200 g of a 10% polyvinyl alcohol aqueous solution and 600 g of water, and milled with a bead mill until it had an average particle diameter of 1 μm.

<Dispersion P>

200 Grams of aluminum hydroxide was dispersed in a mixture of 200 g of a 1% polysodiumacrylate aqueous solution and 600 g of water, and stirred with a homomixer for 10 minutes.

Example 38

Dispersions A-1, B-1, C-1 and P prepared in Preparation Example 2 and the following components were mixed in the following mixing ratio and fully stirred to obtain a coating solution for a heat-sensitive recording layer.

| | |
|---|---|
| Dispersion A-1 | 20 parts |
| Dispersion B-1 | 20 parts |
| Dispersion C-1 | 5 parts |
| 40% zinc stearate aqueous dispersion | 3.5 parts |
| Dispersion P | 25 parts |
| 10% Polyvinyl alcohol aqueous solution | 35 parts |
| Water | 10 parts |

The above-prepared coating solution for a heat-sensitive recording layer was coated on a substrate paper having a basis weight of 40 g/m$^2$ with a wire bar so as to form a coating having a dry coating weight of 5 g/m$^2$ and then dried. The resultant coating was super-calendered to give a heat-sensitive recording material.

Examples 39–53 and Comparative Examples 14–28

Heat-sensitive recording materials were prepared in the same manner as in Example 38 except that Dispersions A-1 (color former), B-1 (color developer) and C-1 (additive) were replaced with Dispersions shown in Tables 10 and 11.

The heat-sensitive recording materials obtained in Examples 39 to 53 and Comparative Examples 14 to 28 were evaluated for various properties by the following methods. Tables 12 and 13 show the results.

[Dynamic Color Density]

A printing test was carried out on a heat-sensitive recording material with a thermal paper printing machine (thermal head resistance value 1,645 Ω) supplied by Ohkura Denki K. K. at a dot density of 8 dots/mm, at an applied voltage of 21 V and for a pulse width of 1.2 ms. An obtained recorded image portion was measured for an optical density with a Macbeth RD-918 (visual filter). A formed color density of at least 1.2 in a pulse width of 1.2 ms is a level at which a sufficient recording sensitivity can be obtained when printing is carried out with a general printer.

[Heat Durability for Retaining Recorded Image]

A printing test was carried out on a heat-sensitive recording material with a thermal paper printing machine (thermal head resistance value 1,645 Ω) supplied by Ohkura Denki K. K. at an applied voltage of 21 V and for a pulse width of 1.2 ms. A hot block having a temperature of 120° C. or 150° C. was pressed to an obtained print of a recorded image with a heat gradient tester (Heat gradient type H-100, supplied by Toyo Seiki K. K.). The so-treated ground portion and recorded image portion were measured for an optical density with a Macbeth RD-918 (visual filter), and a contrast was calculated on the basis of the following equation. A contrast of at least 0.25 is a level at which a recorded image is sufficiently visually readable.

Contrast=(Optical density of treated recorded portion)—(optical density of treated ground portion)

TABLE 10

| | Dispersion | | | | | |
|---|---|---|---|---|---|---|
| | Color former | | Color developer | | Additive | |
| | Kind | (part) | Kind | (part) | Kind | (part) |
| Ex. 38 | A-1 | 20 | B-1 | 20 | C-1 | 5 |
| Ex. 39 | A-2 | 20 | B-1 | 20 | C-1 | 5 |
| Ex. 40 | A-3 | 20 | B-1 | 20 | C-1 | 5 |
| Ex. 41 | A-4 | 20 | B-1 | 20 | C-1 | 5 |
| Ex. 42 | A-5 | 20 | B-1 | 20 | C-1 | 5 |
| Ex. 43 | A-1 | 20 | B-2 | 20 | C-1 | 5 |
| Ex. 44 | A-4 | 20 | B-2 | 20 | C-1 | 5 |
| Ex. 45 | A-5 | 20 | B-2 | 20 | C-1 | 5 |
| Ex. 46 | A-4 | 20 | B-1 | 20 | C-2 | 5 |
| Ex. 47 | A-5 | 20 | B-1 | 20 | C-2 | 5 |
| Ex. 48 | A-1 | 20 | B-3 | 20 | C-1 | 5 |
| Ex. 49 | A-4 | 20 | B-3 | 20 | C-1 | 5 |
| Ex. 50 | A-4 | 20 | B-1 | 20 | C-1 | 20 |
| Ex. 51 | A-5 | 20 | B-1 | 20 | C-1 | 20 |
| Ex. 52 | A-4 | 20 | B-2 | 20 | C-1 | 20 |
| Ex. 53 | A-5 | 20 | B-2 | 20 | C-1 | 20 |

Ex. = Example

TABLE 11

| | Dispersion | | | | | |
|---|---|---|---|---|---|---|
| | Color former | | Color developer | | Additive | |
| | Kind | (part) | Kind | (part) | Kind | (part) |
| CEx. 14 | A-1 | 20 | B-1 | 20 | — | — |
| CEx. 15 | A-4 | 20 | B-1 | 20 | — | — |
| CEx. 16 | A-1 | 20 | B-1 | 20 | — | — |
| CEx. 17 | A-1 | 20 | — | — | C-1 | 5 |
| CEx. 18 | A-2 | 20 | — | — | C-1 | 5 |
| CEx. 19 | A-4 | 20 | — | — | C-1 | 5 |
| CEx. 20 | A-4 | 20 | — | — | C-1 | 30 |
| CEx. 21 | A-1 | 20 | B-4 | 20 | C-1 | 5 |
| CEx. 22 | A-4 | 20 | B-5 | 20 | C-1 | 5 |
| CEx. 23 | A-1 | 20 | B-1 | 20 | C-3 | 5 |
| CEx. 24 | A-2 | 20 | B-1 | 20 | C-4 | 5 |

TABLE 11-continued

| | Dispersion | | | | | |
|---|---|---|---|---|---|---|
| | Color former | | Color developer | | Additive | |
| | Kind | (part) | Kind | (part) | Kind | (part) |
| CEx. 25 | A-3 | 20 | B-1 | 20 | C-5 | 5 |
| CEx. 26 | A-4 | 20 | B-1 | 20 | C-5 | 5 |
| CEx. 27 | A-1 | 20 | B-2 | 20 | C-5 | 5 |
| CEx. 28 | A-5 | 20 | B-2 | 20 | C-4 | 5 |

CEx. = Comparative Example

TABLE 12

| | Dynamic color density | Heat durability for retaining recorded image | | | |
|---|---|---|---|---|---|
| | | 120° C. | | 150° C. | |
| | | Ground portion | Contrast | Ground portion | Contrast |
| Ex. 38 | 1.46 | 0.91 | 0.56 | 1.15 | 0.33 |
| Ex. 39 | 1.42 | 0.70 | 0.71 | 1.08 | 0.31 |
| Ex. 40 | 1.45 | 0.79 | 0.67 | 1.14 | 0.30 |
| Ex. 41 | 1.44 | 0.56 | 0.90 | 0.98 | 0.45 |
| Ex. 42 | 1.47 | 0.97 | 0.50 | 1.41 | 0.05 |
| Ex. 43 | 1.31 | 1.04 | 0.28 | 1.13 | 0.20 |
| Ex. 44 | 1.24 | 0.77 | 0.46 | 1.04 | 0.22 |
| Ex. 45 | 1.32 | 1.01 | 0.31 | 1.29 | 0.02 |
| Ex. 46 | 1.17 | 0.54 | 0.62 | 0.88 | 0.30 |
| Ex. 47 | 1.19 | 0.83 | 0.37 | 1.17 | 0.01 |
| Ex. 48 | 1.30 | 0.92 | 0.40 | 1.11 | 0.22 |
| Ex. 49 | 1.25 | 0.63 | 0.64 | 0.99 | 0.28 |
| Ex. 50 | 1.42 | 0.96 | 0.47 | 1.33 | 0.10 |
| Ex. 51 | 1.45 | 1.20 | 0.25 | 1.42 | 0.01 |
| Ex. 42 | 1.36 | 1.05 | 0.32 | 1.35 | 0.02 |
| Ex. 53 | 1.39 | 1.17 | 0.20 | 1.36 | 0 |

Ex. = Example

TABLE 13

| | Dynamic color density | Heat durability for retaining recorded image | | | |
|---|---|---|---|---|---|
| | | 120° C. | | 150° C. | |
| | | Ground portion | Contrast | Ground portion | Contrast |
| CEx. 14 | 0.71 | 0.57 | 0.16 | 0.63 | 0.10 |
| CEx. 15 | 0.46 | 0.27 | 0.20 | 0.58 | 0.02 |
| CEx. 16 | 0.51 | 0.23 | 0.29 | 0.47 | 0.05 |
| CEx. 17 | 0.27 | 0.29 | 0.01 | 0.39 | 0 |
| CEx. 18 | 0.24 | 0.26 | 0.01 | 0.42 | 0 |
| CEx. 19 | 0.22 | 0.23 | 0 | 0.48 | 0.01 |
| CEx. 20 | 0.38 | 1.01 | 0 | 1.09 | 0.01 |
| CEx. 21 | 1.42 | 1.44 | 0 | 1.43 | 0 |
| CEx. 22 | 1.26 | 1.31 | 0.02 | 1.34 | 0.01 |
| CEx. 23 | 1.41 | 1.41 | 0.01 | 1.39 | 0 |
| CEx. 24 | 1.33 | 1.34 | 0 | 1.34 | 0.01 |
| CEx. 25 | 1.37 | 1.40 | 0 | 1.39 | 0 |
| CEx. 26 | 1.33 | 1.36 | 0.01 | 1.36 | 0.01 |
| CEx. 27 | 1.24 | 1.29 | 0 | 1.26 | 0 |
| CEx. 28 | 1.28 | 1.30 | 0.01 | 1.28 | 0.01 |

CEx. = Comparative Example

The above Tables 12 and 13 show the following. The heat-sensitive recording materials of Examples 38 to 53 having heat-sensitive recording layers containing the dye precursor, the diphenylsulfone derivative as an electron-accepting compound which reacts with the dye precursor to cause the dye precursor to form a color and the salicylamide derivative as an additive have excellent recording sensitivity since they exhibit high dynamic color density as compared with the counterparts of Comparative Examples 14 to 28. Further, the heat-sensitive recording materials of Examples 38 to 53 give recorded products of which recorded portions are visually easily readable due to a clear contrast between recorded portions and ground portions since the ground portions do not completely form a color even when brought into contact with the hot block having a temperature of 120° C. and since no decrease was found in the density of the recorded portions.

The heat-sensitive recording materials of Examples 48 and 49 having heat-sensitive recording layers containing, as an electron-accepting compound, 4-hydroxy-4'-n-propoxydiphenylsulfone having a melting point of over 150° C., are excellent in heat durability for retaining recorded images, since the contrast between recorded portions and ground portions after the recorded products thereof are brought into contact with the hot block having a temperature of 120° C. is high as compared with the recorded products of the heat-sensitive recording materials of Examples 43 and 45.

The heat-sensitive recording materials of Examples 38, 41 and 42 having heat-sensitive recording layers containing, as an electron-accepting compound, 4,4'-dihydroxydiphenylsulfone are excellent in heat durability for retaining recorded images, since the contrast between recorded portions and ground portions after the recorded products thereof are brought into contact with the hot block having a temperature of 120° C. is high as compared with the recorded products of the heat-sensitive recording materials of Examples 43, 44 and 45.

Further, in Examples 38 to 41, the heat-sensitive recording layer contains, as a dye precursor, 3-di-n-butylamino-6-methyl-7-anilinofluoran (melting point 182° C.), 3-dibutylamino-7-(o-chloroanilino)fluoran (melting point 186° C.), 3-diethylamino-7-(m-trifluoromethylanilino) fluoran (melting point 181° C.) or 3-(N-ethyl-N-p-tolyl) amino-6-methyl-7-anilinofluoran (melting point 207° C.). The heat-sensitive recording materials of these Examples 38 to 41 are excellent in heat durability for retaining recorded images, since-the contrast between recorded portions and ground portions after the recorded products thereof are brought into contact with the hot block having a temperature of 150° C. is high as compared with the recorded product of the heat-sensitive recording material of Example 42 having the heat-sensitive recording layer containing 3-(N-ethyl-N-isobutyl)amino-6-methyl-7-anilinofluoran (melting point 164° C.) as a dye precursor having a melting point of 180° C. or lower. The above tendency is also found between the heat-sensitive recording material of Example 43 or 44 having the heat-sensitive recording layer containing 4-hydroxy-4'-isopropoxydiphenylsulfone as an electron-accepting compound and 3-di-n-butylamino-6-methyl-7-anilinofluoran or 3-(N-ethyl-p-tolyl)amino-6-methyl-7-anilinofluoran as a dye precursor and the heat-sensitive recording material of Example 45 having the heat-sensitive recording layer containing 3-(N-ethyl-N-isobutyl)amino-6-methyl-7-anilinofluoran. Further, the above tendency is also found between the heat-sensitive recording material of Example 46 having the heat-sensitive recording layer containing 5-tert-butylsalicyl-p-methoxyanilide as an additive and 3-(N-ethyl-N-p-tolyl)amino-6-methyl-7-anilinofluoran as a dye precursor and the heat-sensitive recording material of Example 47 having the heat-sensitive recording layer contaning 3-(N-ethyl-N-isobutyl)amino-6-methyl-7-anilinofluoran. It has been therefore found that the use of a dye precursor having a melting point of at least 180° C. is more effective for achieving high heat durability for retaining recorded images.

Further, in Examples 41, 42, 44 and 45, the content of the salicylamide derivative per part by weight of the dye precursor is less than 1 part by weight. In Examples 50 to 53, the content of the salicylamide derivative per part by weight of the dye precursor is 1 part by weight. The heat-sensitive recording materials of Examples 41, 42, 44 and 45 have excellent heat durability for retaining recorded images over the heat-sensitive recording materials of Examples 50 to 53, since the contrast between recorded portions and ground portions after the recorded products thereof are brought into contact with the hot block having a temperature of 120° C. is higher.

In Comparative Examples 14 to 16, no salicylamide derivative is added. Although the heat-sensitive recording materials of Comparative Examples 14 to 16 give recorded products having a contrast between a recorded portion and a ground portion after the recorded products thereof are brought into contact with the hot block having a temperature of 120° C., they are poor in recording sensitivity as compared with the heat-sensitive recording materials of Examples 38, 41, 43, 46 and 50 in which the heat-sensitive recording layers contain the salicylamide derivative. In Comparative Examples 17 to 19, no diphenylsulfone derivative is added. The heat-sensitive recording materials of Comparative Examples 17 to 19 show lower dynamic color desnsitity than the heat-sensitive recording materials of Examples 38, 39, 41, 43, 44, 48, 49, 50 and 52 and have no sufficient recording sensitivity, and further, they have no high heat durability for retaining recoreded images.

In Comparative Example 21 in which the electron-accepting compound used in Example 38 is changed from 4,4'-dihydroxydiphenylsulfone to 2,2-bis(hydroxyphenyl) propane, and in Comparative Example 22 in which the electron-accepting compound used in Example 4 is changed from 4,4'-dihydroxydiphenylsulfone to 1,1-bis (hydroxyphenyl)-cyclohexane, the heat-sensitive recording materials show high dynamic color density, and sufficient recording sensitivity is achieved, while the heat-sensitive recording materials have no high heat durability for retaining recorded images.

Further, in Comparative Examples 23 and 24 in which the salicylamide derivative is removed and other heat-meltable substance is added, the heat-sensitive recording materials have no high heat durability for retaining recorded images.

The above results show the following: When the diphenylsulfone derivative as an electron-accepting compound and the salicylamide derivative as an additive are used, there can be obtained a heat-sensitive recording material which has excellent recording sensitivity, is free from complete color formation when brought into contact with a high-temperature heating material having a temperature of 120° C. and is free from a decrease in the density of a recorded portion so that a record is visually readable owning to a sufficient contract in the recorded portion and a ground portion.

Example 54

[Preparation of Coating Solution for Undercoating Layer]

A coaing solution for an undercoating layer, having a solid content of 45% was prepared from the following components.

| | |
|---|---|
| Water | 107 parts |
| 10% sodium hexametaphosphate | 8 parts |
| Calcined kaoline (trade name: Ancylex, supplied by Engelhard) | 100 parts |
| 25% Starch oxide aqueous solution | 24 parts |
| 48% SBR latex | 25 parts |

[Formation of Undercoating Layer]

The above coating solution was applied to a substrate paper having a basis weight of 50 g/m2 with a blade coater and dried so as to form a coating having a coating weight of 6 g/m$^2$, whereby an undercoating layer was formed.

[Preparation of Coating Solution for Heat-sensitive Recording Layer]

(1) Preparation of Solution A

The following components were dispersed for 10 hours.

| | |
|---|---|
| 10% denatured polyvinyl alcohol solution ("Goseran L3266", supplied by Nippon Gosei K.K.) | 80 parts |
| 3-dibutylamino-6-methyl-7-anilinoflouran | 100 parts |
| Water | 180 parts |

The dispersion was milled with a dyanomill (supplied by Simaru Enterprises) until the 3-dibutylamino-6-methyl-7-anilinofluoran had a volume average particle diameter of 1.5 $\mu$m, to obtaina a solution A.

(2) Preparation of Solution B

The following components were dispersed for 10 hours.

| | |
|---|---|
| 15% ammonium salt of styrene maleic acid anhydride copolymer ("Polymaron 1318", supplied by Arakawa Kagaku K.K.) | 34 parts |
| 4,4'-dihydroxydiphenyldiphenylsulfone ("BPS-P", supplied by Nikka Kagakusha) | 40 parts |
| Dibenzyl oxalate ("HS2046", supplied by Dainippon Ink & Chemicals, Inc.) | 30 parts |
| Salicylanilide ("Tomirak SA", supplied by Yoshitomi Fine Chemical K.K.) | 30 parts |
| Water | 130 parts |

The above dispersion was milled with a dyanomill (supplied by Simaru Enterprises) until a solid had a volume average particle diameter of 1.5 $\mu$m, to obtain a solution B.

(3) Preparation of Solution C.

The following components were dispersed for 10 hours.

| | |
|---|---|
| 15% ammonium salt of styrene maleic acid anhydride copolymer ammonium salt | 34 parts |
| 4,4'-dihydroxydiphenylsulfone | 40 parts |
| 2-benzyloxynaphthalene ("BON", supplied by Ueno Pharmaceuticals) | 60 parts |
| Water | 130 parts |

The above dispersion was milled with a dyanomill (supplied by Simaru Enterprises) until a solid had a volume average particle diameter of 1.5 $\mu$m to obtain a solution C.

[Formation of Heat-sensitive Recording Layer]

A coating solution for a heat-sensitive recording layer was prepared from the solutions A and B and the following components. The coating solution was applied onto the above undercoating layer at 300 m/minute and dried with a air knife coater to form a coating having a dry weight of 5 g/m$^2$. Then, the resultant coated paper was calendered to have a Bekk smoothness of 400 to 600 seconds, whereby a heat-sensitive recording material was obtained.

| | |
|---|---|
| Polyvinyl alcohol solution (10% aqueous solution) | 500 parts |
| Calcium carbonate | 100 parts |
| Solution A | 100 parts |
| Solution B | 264 parts |
| 40% Zinc stearate aqueous dispersion | 40 parts |
| Water | 250 parts |

Example 55

[Formation of Coating Solution for Overcoming Layer]

A coating solution for an overcoating layer was prepared from the following components.

| | |
|---|---|
| Water | 115 parts |
| 5% Polyvinyl alcohol aqueous solution | 100 parts |
| 20% Acryl emulsion resin ("Barrier Star OM1050", supplied by Mitsui Chemicals K.K.) | 50 parts |
| Finely milled silicic acid ("Mizukasil", supplied by Mizusawa Kagaku K.K.) | 10 parts |
| 40% Zinc stearate aqueous diseprsion | 5 parts |

[Formation of Overcoating Layer]

The above coating solution was applied onto the heat-sensitive recording layer formed in Example 54 with a rod coater and dried so as to form a coating having a dry weight of 2 g/m$^2$, and the resultant coated paper was calendered to have a Bekk smoothness of 700 to 1,000 seconds, whereby a heat-sensitive recording material was obtained.

Example 56

A heat-sensitive recording material was obtained in the same manner as in Example 54 except that 50 parts of a 20% stearic acid amide aqueous dispersion (??"Hydorin G270", supplied by Chukyo Yushi K. k.) was incorporated into the coating solution for a heat-sensitive recording layer and that the coating solution was applied and dried so as to form a coating having a dry weight of 5.5 g/m$^2$.

Example 57

A heat-sensitive recording material was obtained in the same manner as in Example 56 except that 50 parts of the 20% stearic acid amide aqueous dispersion was replaced with 36 parts of a 28% N,N'-ethylenebisstearic acid amide aqueous dispersion ("Hydorin B961", supplied by Chukyo Yushi K. k.).

Example 58

A heat-sensitive recording material was obtained in the same manner as in Example 56 except that 50 parts of the 20% stearic acid amide aqueous dispersion was replaced with 56 parts of a 18% palmitic acid amide aqueous dispersion ("K-646", supplied by Chukyo Yushi K. k.).

Comparative Example 29

A heat-sensitive recording material was obtained in the same manner as in Example 54 except that the solution B was replaced with the soltuion C.

Comparative Example 30

A heat-sensitive recording material having an overcoating layer was obtained in the same manner as in Example 55 except that the heat-sensitive recording material obtained in Example 54 was replaced with the heat-sensitive recording material obtained in Comparative Example 29.

The heat-sensitive recording materials obtained in Examples 54 to 58 and Comparative Example 29 and 30 were evaluated for sensitivity by the following method. Table 14 shows the results.

[Evaluation of Sensitivity]

Printing was carried out with a testing machine supplied by Okura Denki K. K. having a head having a head resistance of 1,335 Ω (supplied by Kyocera Corp.) for 10 ms/line with an energy of 25 mJ/dot, and an image portion was measured for a print density with a Macbeth RD-918.

TABLE 14

| | Print density |
|---|---|
| Example 54 | 1.20 |
| Example 55 | 1.10 |
| Example 56 | 1.25 |
| Example 57 | 1.23 |
| Example 58 | 1.24 |
| Comparative Example 29 | 0.85 |
| Comparative Example 30 | 0.75 |

What is claimed is:

1. A heat-sensitive recording material having a heat-sensitive recording layer containing an electron-donating dye precursor and an electron-accepting compound which reacts with the electron-donating dye precursor under heat to cause the electron-donating dye precursor to form a color, wherein the heat-sensitive recording layer contains a combination of 4-hydroxy-4'-isopropoxydiphenylsulfone with 4-hydroxy-4-n-propoxydiphenylsulfone as the electron-accepting compounds.

2. The heat-sensitive recording material of claim 1, wherein the 4-hydroxy-4'-n-propoxydiphenylsulfone is used in an amount of at least 5% by weight based on the 4-hydroxy-4'-isopropoxydiphenylsulfone.

3. A heat-sensitive recording material having a heat-sensitive recording layer containing an electron-donating dye precursor and an electron-accepting compound which reacts with the electron-donating dye precursor under heat to cause the electron-donating dye precursor to form a color, wherein the heat-sensitive recording layer contains a combination of 4,4'-dihydroxydiphenylsulfone with at least two diphenylsulfone derivatives as the electron-accepting compound.

4. The heat-sensitive recording material of claim 3 wherein the at least two other diphenylsulfone derivatives are selected from compounds of the formula (II),

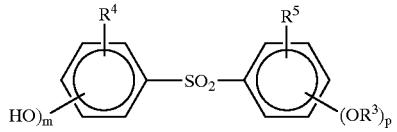

(II)

wherein $R^3$ is hydrogen, alkyl, alkenyl, aralkyl or aryl, each of $R^4$ and $R^5$ is independently hydrogen, halogen, alkyl, alkenyl, aralkyl, aryl or phenylsulfonyl, and each of m and p is an integer of 1 to 4, provided that 4,4'-dihydroxydiphenylsulfone is not included in the compounds of the formula (II).

5. The heat-sensitive recording material of claim 4, wherein the at least two other diphenylsulfone derivatives are compounds selected from the group consisting of 4-benzyloxy-4'-hydroxydiphenylsulfone, 4-hydroxy-4'-isopropoxydiphenylsulfone, 2,4'-dihydroxydiphenylsulfone, 3,3'-diallyl-4,4'-dihydroxydiphenylsulfone and 4-hydroxy-4'-n-propoxydiphenylsulfone.

6. The heat-sensitive recording material of claim 5, wherein the at least two other diphenylsulfone derivatives are a combination of 4-benzyloxy-4'-hydroxydiphenylsulfone, 4-hydroxy-4'-isopropoxydiphenylsulfone and 2,4'-diphydroxydiphenylsulfone or a combination of 4-benzyloxy-4'-hydroxydiphenylsulfone, 2,4'-dihydroxydiphenylsulfone and 3,3 diallyl-4,4'-dihydroxydiphenylsulfone.

7. The heat-sensitive recording material of claim 3 wherein the electron-accepting compound has a 4,4'-dihydroxydiphenylsulfone content of 25 to 75% by weight.

* * * * *